US005800956A

United States Patent [19]

Minemura et al.

[11] Patent Number: 5,800,956

[45] Date of Patent: Sep. 1, 1998

[54] ELECTROPHOTOGRAPHIC PHOTORECEPTOR WITH SPECIFIC INTERLAYER

[75] Inventors: Hiroaki Minemura; Eiichi Sakai; Kenichi Yasuda; Yohko Kitahara, all of Hachioji, Japan

[73] Assignee: Konica Corporation, Tokyo, Japan

[21] Appl. No.: 917,028

[22] Filed: Aug. 22, 1997

Related U.S. Application Data

[63] Continuation of Ser. No. 590,095, Jan. 24, 1996, abandoned.

[30] Foreign Application Priority Data

Jan. 30, 1995 [JP] Japan ..... 7-012729

[51] Int. Cl.[6] ..... G03G 5/14

[52] U.S. Cl. ..... 430/60; 430/64; 430/69

[58] Field of Search ..... 430/60, 64, 65, 430/69

[56] References Cited

U.S. PATENT DOCUMENTS

| | | | |
|---|---|---|---|
| 5,188,916 | 2/1993 | Hodumi et al. . | |
| 5,252,422 | 10/1993 | Okano et al. . | |
| 5,286,591 | 2/1994 | Hongo . | |
| 5,338,637 | 8/1994 | Kinoshita et al. . | |
| 5,372,904 | 12/1994 | Yu et al. . | |
| 5,434,027 | 7/1995 | Oshiba et al. | 430/64 |
| 5,443,934 | 8/1995 | Suzuki et al. | 430/65 |
| 5,464,717 | 11/1995 | Sakaguchi et al. | 430/65 |

FOREIGN PATENT DOCUMENTS

| | | |
|---|---|---|
| 0 671 663 A1 | 9/1995 | European Pat. Off. . |
| 42 21 599 A1 | 1/1993 | Germany . |

OTHER PUBLICATIONS

Patent Abstracts of Japan, vol. 94, No. 12 of JP–A–06 337533 (1994).

Derwent Publications Ltd., AN 93–021953 of JP–A–04 348 351 (1992).

Brosenberger, Paul M. and David S. Weiss. Organic Photoreceptors for Imaging Systems. New York: Marcel–Dekker, Inc. pp. 330–345 & 356–361, 1993.

*Primary Examiner*—Christopher D. Rodee

*Attorney, Agent, or Firm*—Frishauf, Holtz, Goodman, Langer & Chick, P.C.

[57] ABSTRACT

A photoreceptor for electrophotography is disclosed. The photoreceptor has an electroconductive substrate, and an interlayer and a photoconductive layer provided on the substrate in this order from the substrate; the electroconductive substrate has a ten-point mean roughness $R_z$ of from 0.5 μm to 4.0 μm; and the interlayer comprises a reaction product of an organic metal compound with a formula $(RO)_mMX_n$ and a silane coupling agent.

The average thickness L of the interlayer and the ten-point mean roughness of the surface of said substrate satisfy the following requirement:

$$0.3\ \mu m+(0.1\times R_z\ \mu m)\leq L\ \mu m\leq 3.0\ \mu m+(0.5\times R_z\ \mu m).$$

7 Claims, 9 Drawing Sheets

ELECTROPHOTOGRAPHIC PHOTORECEPTOR WITH SPECIFIC INTERLAYER

This application is a Continuation of application Ser. No. 08/590,095, filed Jan. 24, 1996 abandoned.

FIELD OF THE INVENTION

The present invention relates to an photoreceptor for electrophotography.

BACKGROUND OF THE INVENTION

Recently, as for image forming apparatus using electrophotographic process, one having higher copying functions has been in great demand. One of the demands is a realization of a duplicating machine capable of extremely quick copying.

As for photoreceptors which can be mounted in this type of copying machines, one having enhanced sensitivity and high stability during repeated use thereof has been demanded. In order for the photoreceptor to acquire demanded properties, it is extremely important to use a carrier generation material, which is hereinafter abbreviated to CGM, having excellent properties, and, heretofore, a lot of materials including azo compounds and polycyclic quinone compounds have been proposed. Among these, perylene compounds and, especially, imidazoleperylene compounds have attracted attention in view of enhanced sensitivity and excellent stability during repeated use.

Another recent demand for image forming apparatus is to have a suitability for use as an output device usable for outputting device for computor or image processing apparatus. Concrete examples of such apparatus are a laser beam printer, hereinafter abbreviated to LBP, and a digital copying machine. As for the photoreceptors which can be mounted in these types of apparatuses, materials having sufficient sensitivity to long wavelength light emmited from a light source such as a semiconductor laser is necessary. Recently, phthalocyanine compounds which have high sensitivity to longer wavelengths light have drawn attention as CGM. The phthalocyanine compounds are largely divided into two types; i.e., metallic phthalocyanine and non-metallic phthalocyanine, and a variety of compounds have so far been proposed. Inter alia. titanyl phthalocyanines, which are hereinafter referred to as TiOPc, have drawn great attention as CGM which can realize high sensitivity and high image quality. TiOPc is quite suitable as a photoreceptive material for image forming apparatuses having a light source of a semiconductor laser, LED, EL (electro luminescience) and LCD (liquid crystal diode) because TiOPc has a sufficient light sensitivity at long wavelength region of 600 nm to 850 nm (hereinafter "long wavelength region" means the region of 600 nm to 850 nm). These light sources emit light having its main energy peak in this wavelength region.

However, attainment of the above-mentioned demands for the high-speed copiers and the semiconducor laser may be difficult only by the improvement of CGM, and technical development in various other technical fields has also been requested.

One of such demands is an improvement in an interlayer.

The interlayer is usually arranged between a electroconductive substrate and a photoconductive layer and is provided for the purposes of enhancement of adhesion in the mechanical point of view, and restriction of defects in the image in the electrical point of view. Particularly in the reversal development process, which is commonly employed in laser printers, defects in the image, such as small black spots in a solid white background and transfer-memory defect have often been found. In the case of normal development, the spot defects appears as white spots in a solid black image. In order to restrict these image defects, an interlayer having more excellent properties has been desired. As for such interlayer, for example, that composed of a polyamide resin, polyester resin or polyurethane resin have been well known and used popularly.

When such resin layer is used as the interlayer in combination with the above-mentioned imidazoloperylene compounds or TiOPc as a CGM, images with excellent contrast and resolving power can be obtained, even when they are used in high speed machines. However, this happens only when they are used under normal temperature and humidity conditions, and, in addition, such excellent properties are obtainable stably only in the initial stage of a continuous copying operation. Several serious problems appear when they are used under different conditions; e.g., under high temperature, high humidity, low temperature and low humidity conditions; or under a large amount of continuous copying.

For example, under high temperature and high humidity conditions, resistivity of the resinous interlayer is lowered and the function as a barrier is also lowered. In addition, since carrier generation ability of the imidazoloperylene compounds or TiOPc is quite high and, thus, holes tend to be injected easily and image defects such as black spots or white spots may easily be caused. Under low temperature and low humidity conditions, on the other hand, resistivity of the resin layer increases and the barrier function is also elevated, thus problems of lowering of sensitivity, increase of the residual potential appear. Particularly, when TiOPc is used as CGM, carrier generation ability of the TiOPc being relatively low under low temperature and low humidity conditions, the above-mentioned problems remarkably appear.

Thus, when the resinous interlayer is used in combination with the imidazoloperylene compounds or TiOPc, while there are some advantages, due to the two main functional causes. i.e., high carrier generation ability of the CGM and variability of resistivity of the resinous layer, serious problems such as occurrence of white spots or black spots, and deterioration in the electrification properties.

Particularly, when TiOPc is used as CGM and the resin layer is used in combination, other problem can take place in addition to the above-mentioned problems. The problem is creation of strong transfer-memory when a reversal developing process is applied in the image forming apparatus in which a photoreceptor using TiOPc is employed, the reversal development is usually applied in a LBP or a digital copying machine.

In the LBP or digital copying machines, the surface of the photoreceptor corresponding to image portion is usually exposed with laser light, and, then, reversal development is carried out. In the case of a negatively chargeable photoreceptor, transferring electrification is carried out with positive charging. Negatively charged potential induced by the positive charged potential generated on the surface of the photoreceptor is considered to be present near the interface between a photoconductive layer such as the carrier generation layer and the resinous interlayer. If the next electrification is conducted while this negative charge remains or, before the negative charge has not yet been eliminated, sufficient electrification potential may not be obtained and causes fogging in the image, or transfer memory takes place.

In the case when TiOPc is used as the CGM, injection of electrons from the substrate is more likely to take place compared with the case where another compound such as an azo compound is used, and the surface of the photoreceptor is inclined to be re-electrified in the opposite polarity relative to the initial electrification. Moreover, negative potential induced by the positive electrification becomes more difficult to eliminate because of the presence of the resinous interlayer and, thus, the problem of the transfer memory has been a distinguished problem to be solved when TiOPc is used as the CGM in combination with the resinous interlayer.

Attempts to solve these problems by improving the properties of the interlayer have so far been made. for example, a method of dispersing inorganic or inorganic electroconductive fine particles in the resin layer has been attempted, however, sufficient property has not yet been obtained, because, in one case effect of improving potential property was insufficient and, in another case, image defect became more likely to take place and stability of dispersion of the coating solution became insufficient.

Further, in Japanese Patent O.P.I. Publication No.58-93062(1983), a technology of forming the interlayer by mixing a resin with a metal alkoxide compound or an organic metal compound is described. However, only insufficient improvement in the potential property has been obtainable by this.

Apart from the technology of using the above-mentioned resin layer or a resin-containing layer, a technology of forming the interlayer without using resins but with the use of organic metal compounds and silane coupling agents in combination has also been proposed. For example, Japanese Patent O.P.I. Publication No. 62-272277(1987) discloses use of metal alkoxide compounds or silane coupling agents. However, only insufficient improvement in the potential property has been obtained. Further, Japanese patent O.P.I. Publication Nos. 3-73962(1991) and 4-36758(1992) disclose use of zirconium chelate compounds in combination with the silane coupling agents.

However, no technologies, which bring sufficient improvement have not yet been found.

In the present specification the interlayer comprising the above-mentioned organic metal compounds or silane coupling agents is referred to as a ceramic interlayer just for the purpose of clearly separating this from the resinous interlayer. The present invention relate to the ceramic interlayer having remarkably excellent properties.

After intensive research and evaluation of the ceramic-type interlayers heretofore known in the art, the present inventors have found that there causes following problems concerning film forming ability.

Different from the resinous layer, the ceramic type interlayer is formed by coating a coating solution comprised of relatively low molecular weight components. The coated layer is dries and hardened, to cause polymerization reaction with respective components so as finally to make it a thin layer having a network structure. However, the ceramic type of interlayer have defect in the film formation property and a crack is often caused when thickness of the layer exceeds a 1certain degree. If a crack is formed in the interlayer, the crack portion often turns out to be an image defect such as a white spot or a black spot. Therefore, photoreceptors having such a defect may not be susceptible of commercial use. For this reason, when a ceramic type interlayer is applied, it has been necessary to restrain the thickness of the interlayer so as not to exceed the certain degree and use it as relatively a thin layer. However, when the layer is used as this thickness, blocking property as an interlayer becomes insufficient, and image defects such as white spots or black spots, increase in the dark decay and lowering of electrification property are caused again. Thus, it has been extremely difficult to enhance image properties and electric potential properties at the same time.

SUMMARY OF THE INVENTION

The first objective of the present invention is to stably provide a photoreceptor for electrophotography, which is excellent in both electric potential properties and image properties, showing stable film forming performance as an interlayer without causing cracks, and is capable of showing sufficient electrification property and low residual potential without causing image defects such as white spots or black spots.

The second objective of the present invention is to stably provide a photoreceptor for ehectrophotography, which is capable of maintaining images with excellent contrast and potential stability without causing image defects in the image such as white spots, fogging, density lowering, even when it is mounted in as image forming apparatus having high line speed and used repeatedly for a long period of time.

It has been found by the inventors that the first objective of the invention can be attained by using a ceramic type interlayer and making each of the surface roughness of a substrate on which the interlayer is provided, and the thickness of the interlayer to a specified value, respectively.

The photoreceptor of the present invention is an electrophotographic photoreceptor comprising a electroconductive substrate, and an interlayer and a photoconductive layer provided on the substrate in this order from the substrate, wherein the electroconductive substrate has a ten-point mean roughness $R_z$ of from 0.5 μm to 4.0 μm, the interlayer comprises a reaction product of an organic metal compound represented by the following Formula 1 and a silane coupling agent represented by the following Formula 2, and the average thickness L of the interlayer and the ten-point mean roughness $R_z$ of the surface of the substrate satisfy the following requirement:

$$0.3\ \mu m+(0.1\times R_z\ \mu m)\geqq L\ \mu m\geqq 3.0\ \mu m+(0.5\times R_z\ \mu m),$$

Formula 1

$$(RO)_m MX_n$$

wherein R is an alkyl group; M is a metal atom; X is a chelate ligand; and m and n are each an integer of 0 to 4 and the sum of m and n is 3 or 4;

Formula 2

$$(Z)_a(A)_b Si(Y)_c$$

Wherein Z is a halogen atom, an alkoxy group or an amino group; A is an alkyl group or an aryl group; and Y is an organic functional group; and a and c are each an integer of 1 to 3 and b is an integer of 0 to 2 and the sum of a, b and c is 4.

Figure 1:
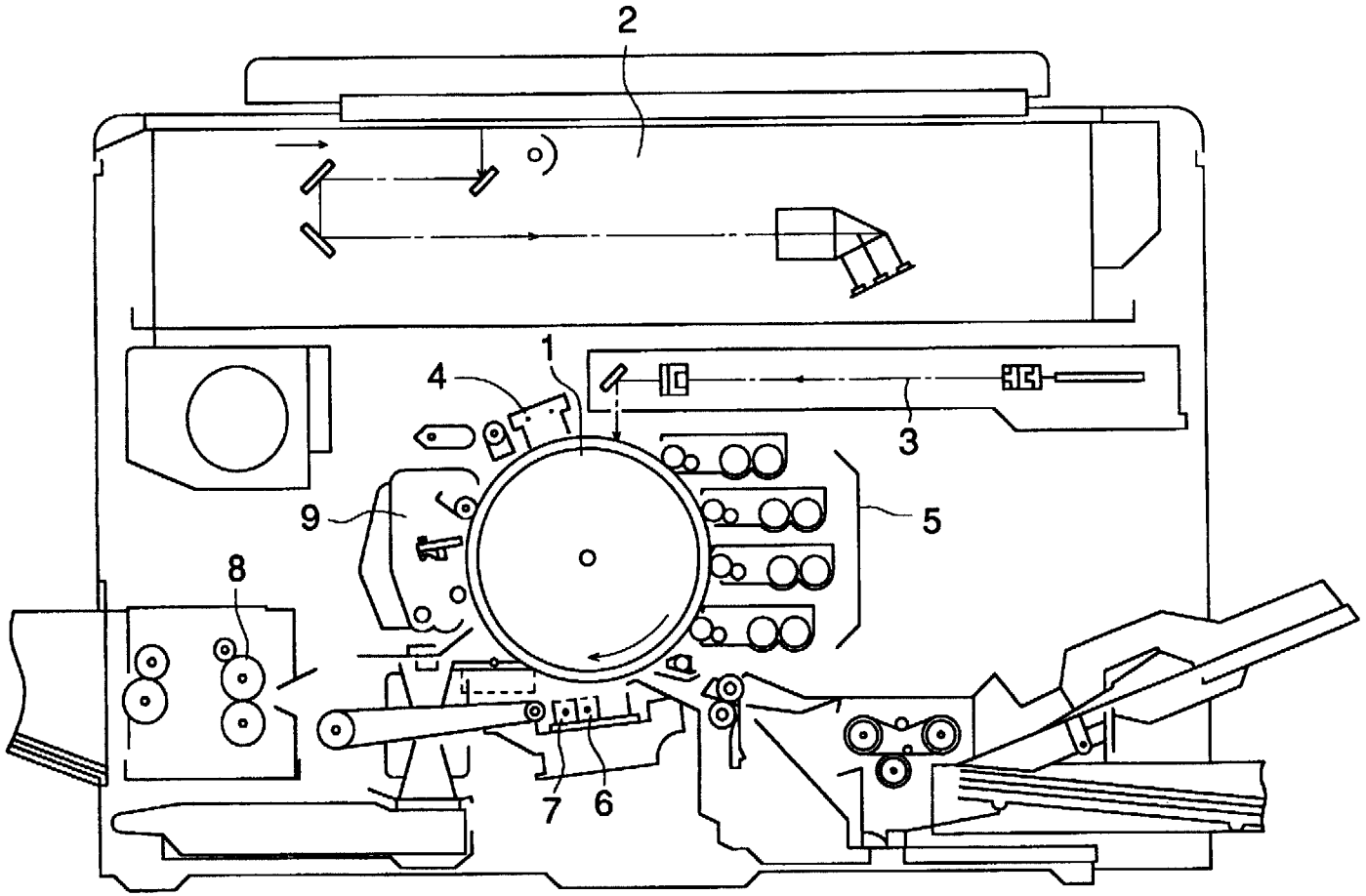
FIG. 1: Cross section of image forming apparatus relating to the invention

Symbols used in the above drawings are as follows:

1; Photoreceptor drum

2: Image reading unit

3; Image writing unit

4: Charging unit

5: Developing unit

6: Transferring electrode

7: Separating electrode

8: Fixing unit

9: Cleaning unit

DETAILED DESCRIPTION OF THE INVENTION

The photoreceptor of the present invention can be prepared by providing a coating solution for the interlayer on an electro-conductive substrate and, after drying and hardening the interlayer, a photoconductive layer is further provided thus formed interlayer.

As for the electroconductive substrate usable in the present invention, any one, which is heretofore known in the art can be used. For example, a substrate made of a metal such as aluminium, stainless steel or a conductive layer, which has been formed by dispersing an electroconductive powder such as metal oxides in a resin layer can be mentioned. However, the scope of the present invention is not limited to these.

According to the present invention, a substrate having predetermined surface roughness may be used among the abovementioned substrates. In the present invention, the surface roughness of the substrate is defined by a ten-point mean roughness RZ. The ten-point mean roughness of the surface is determined, as described in JIS B 0601, by the value of difference in micrometer (μm) between the mean value of altitudes of peaks from the highest to the 5th, measured in the direction of vertical magnification from a straight line that is parallel to the mean line and that does not intersect the profile, and the mean value of altitudes of valleys from the deepest to the 5th, within a sampled portion, of which length corresponds to the reference length, from the profile. Regarding the detailed method for measuring the ten-point mean roughness, JIS B 0601/1982 can be referred.

As to the manner of required roughness on the surface of the substrate, any conventional method can be applied.

For example, the method includes chemical methods such as a chemical etching and an electrical plating, physical methods such as evaporation and sputtering, and mechanical method such as lathing can be mentioned.

Further, the substrate of the present invention includes certain kinds of resinous conductive layers containing conductive powder, in which the surface of the support is made rough due to shape or existing state of the constituents materials.

There is no specific limit with respect to the shape of cross-sectional irregularities of the surface of the support and it may be optional, including, for example, a V-shape, a U-shape and shapes sew teeth.

The interlayer used in the present invention is a ceramic-type layer prepared by dissolving a composition which comprises as the main constituents an organic metal compound such as a metallic alkoxide compound or an organic metal compound and a silane coupling agent in a solvent as a coating solution, and, then coating, drying and hardening it.

In the ceramic interlayer, different from the resinous layer, there has been disadvantages that its film forming property is insufficient even though the layer is made to have a network-structure by hadening with heat since the raw mateials of the layer is composed of low molecular weight compounds. Accordingly, cracks are formed when the thickness of the interlayer exceeds a certain degree. Like this, when cracks areformed, the portions turn out to be image defects in the shape of cracks, which often makes the photoreceptor insuitable for practical use. Therefore, upon applying the ceramic interlayer, it has been necessary for the layer to be used with relatively small thickness, and, because of this, blocking property becomes insufficient and image defects such as white spots or black spots, as well as problems in the electric potential property, such as increase of dark decay and lowering of electrification property when the photoreceptor is used repeatedly, tend to be caused more frequently.

The inventors have carried out searching for a method, by which cracks are not caused even when the ceramic interlayer is formed with sufficient thickness. As a result, we have found that occurrence of cracks can effectively be restricted by roughening the surface of the substrate. Further, after evaluation of image characteristics and potential properties while varying the thickness of the ceramic interlayer, the inventors have found when the surface roughness expressed in terms of the ten-point mean roughness ($R_z$) falls within a range between 0.5 and 4.0 μm, and when the average layer thickness L of the interlayer satisfies the following relation, excellent properties in both image and potential properties can be obtained:

$$0.3\ \mu m+(0.1\times R_z\ \mu m)\geqq L\ \mu m\geqq 3.0\ \mu m+(0.5\times R_z\ \mu m)$$

Hereinbelow grounds, under which the above-mentioned limitation was made is considered.

When the interlayer is formed by thermally hardening, component materials are polymerized with each other, or volatile ingredients volatilize, and thus the interlayer shrinks, causing internal stress, and when this exceeds binding force between components of the interlayer, a crack is assumed tooccur. Mechanism of the reason why occurrence of the crack is restrained by roughening the electroconductive substrate is not yet known clearly. However, it is assumed that roughening of the substrate causes uneven thickness of the interlayer, and, as a result, disturbance in the internal stress is brought about, which results in the reduction of visualization of internal stress.

According to our investigation, it was found that this crack reduction effect becomes remarkable when the surface roughness expressed in terms of $R_z$ is within certain range. For example, in the case when the surface of a substrate is very smooth and $R_z$ is approximately 0 μm, cracks is formed when the thickness of the interlayer is approximately 0.5 μm depending on the nature and kind of the ingredient components.

Moreover, thickness of the interlayer necessarily be a certain level or more in order to restrain occurrence of the image defects like white spots or black spots, increase of dark decay or lowering of electrification property. According to our investigation on this respect, it was found that it preferably be at least 0.3 μm or more.

Accordingly when the surface of the substrate is smooth and $R_z$ is approximately 0 μm, a thickness range of the interlayer in which anti-cracking property and blocking property of an interlayer can be compatible is quite narrow or there might be a case where there exists no any compatible points at all.

Even if an interlayer is formed on the point where the anti-cracking property and the blocking property are compatibly sutisfied, the blocking property of the layer satisfying the requirements at the initial stage is deteriorated by continuous use for a prolonged period or repeat of a number of copying operation. As a result of that, formation of tiny deffect in image and lowering of the electrification property are occurred.

Accordingly, at this stage, it was found that designer of the photoreceptor are obliged to design a ceramic type interlayer with extremely narrow latitude. However, by roughening the surface of the substrate, or, in other words, by making $R_z$ larger, because of the reason assumed in the above or other, cracks are rarely formed even if thickness of the interlayer is made greater to a certain extent. Thus, formation of the interlayer is not necessarily be made at the layer thickness value about which blocking property is critically obtainable. Accordingly, the range within which the anti-cracking property and the blocking property are compatible, may be broadened, and production of the photoreceptor having stable and excellent properties is considered to be possible.

According to our own investigation, the anti-cracking property rapidly improves when $R_z$ is 0.5 μm, and it gradually increases with increase of $R_z$. On the other hand, when $R_z$ exceeds approximately 4.0 μm, partly because washing of the substrate becomes insufficient, and partly because in the case of a photoreceptor of a separation function-type capable of being charged in the negative polarity, a charge generation layer (herinafter referred to CGL), which is to be provided on the interlayer, is hardly formed evenly because of the unevenness of the interlayer, tending to cause an image trouble such as image streaks. Accordingly preferable range of $R_z$ is between 0.5 and 4.0 μm.

On the other hand, the roughness can also be represented in terms of maximum height $R_{max}$ or center line mean roughness $R_a$, other than the ten-point mean roughness $R_z$. According to measurement of various kinds of substrates, $R_z$ and $R_{max}$ take approximately the equivalent value, or sometimes, $R_{max}$ took a little larger value than $R_z$. However, in the case when the appropriate range of the surface roughness range according to the present invention, approximately equivalent results may be obtained when the value of $R_{max}$ is used in stead of the value of $R_z$.

Further, for the surface roughness in terms of centrer line mean roughness $R_a$, according to the data obtained by measuring various substrates in the present invention, there has been often the case the value falls within approximately fell within 1/5 to 1/10 of $R_z$. Therefore, the range 0.5 μm≦$R_z$ μm=4.0 μm is approximately equivalent to 0.05 μm≧$R_a$ μm≦0.80 μm in terms of $R_a$.

It has been found, after investigation by producing various kinds of photoreceptors, the maximum thickness of the interlayer without formation of the cracks is $$3.0\ \mu m+(0.5\times R_z\ \mu m)$$

and the minimum thickness of the interlayer having a blocking property sufficient to prevent image deffect formation is $$0.3\ \mu m+(0.1\times R_z\ \mu m)$$

within the range of 0.5 μm≦$R_z$ μm≦4.0 μm.

As mentioned above, by making the surface roughness in terms of the ten-point mean roughness to fall within the range between 0.5 and 4.0 μm, it becomes possible to broaden the thickness range, within which a ceramic interlayer with excellent properties can be obtained, to the following in comparison with the case when an electroconductive substrate with smooth surface, i.e., $R_z$ is almost zero:

$$0.3\ \mu m+(0.1\times R_z)\leqq L\ \mu m\leqq 3.0\times(0.5\times R_z).$$

The inventor have found a remakable effect of roughening of the substrate surface on the anti-cracking property of the interlayer and a formula expressing the relation between the upper or lower limit of the selectable region of interlayer thickness and the rouphness of the surface of substrate. By this, a guiding principle for the selection of thickness of a ceramic interlayer, for attaining compatibility of film-forming performance with electrical potential and image properties is obtained.

Hereinbelow, detailed explanation is made with reference to optimization of the component materials of the inter layer with which the above compatibility can be attained at higher level.

The ceramic interlayer according to the present invention comprises, as mentioned above, a reaction product of an organic metal compound and a silane coupling agent. Although it is most preferable for it to consist only of the reaction product, it is also applicable when a third component material other than the above-mentioned reaction products is contained.

The organic metal compound to be used in the interlayer of the invention is one prepresented by the following Formula 1:

$$(RO)_mMX_n.$$

n the above formula, R is an alkyl group; M is a metal atom; X is a chelate ligand; and m and n are each an integer of 0 to 4 and the sum of mand n is 3 or 4.

First, it has been found that the organic metal compound to be used a compnent of the interlayer, preferably has an alkoxy group and at least one chlate ligand. Even in the case where a photoreceptor is prepared using a metal alkoxide having only of alkoxy groups such as tetraalkyloxyltitanium, image defects such as white spots or black spots tend to occur. Accordingly it is be more preferable that the organic metal compound has at least one chelate ligand. As the conventionaLly known chelate ligand, following compounds can be mentioneid.(cf. Japanese Patent O.P.I. Publication No.4-247461(1992).

(1) β-diketones such as acetyl acetone and 2,4-heptanedione, (2) Ketoesters such as methyl acetoacetate, ethyl acetoacetate, propyl acetoacetate and butyl acetoacetate, (3) Hydroxyl carboxylic acids such as butyric acid, salicylic acid and malic acid, (4) Hydroxyl carboxylic acid esters such as methyl lactate, ethyl salicylate and ethyl maliate, (5) Glycols such as octane diol and hexane diol, (6) Keto alcohols such as 4-hydroxy-4-methyl-2-pentanone, (7) Amino alcohols such as triethhanolamine, β-diketone of (1) and aceto acetate of (2) show better properties in comparison with compounds of (3) through (7) in every respect including electro-potential property, film-forming performance, adhesion property to the photoconductive layer, image properties and pot-life of the coating solution.

Moreover, there is an appropriate range concerning the number of the chelating forming compound in the organic metal compounds. In the case where the organic metal compound only has a chelate ligand and it does not have any alkoxy group, residual potential tends to become relatively high. Accordingly, it is preferable for an alkoxy group to be contained, and, if possible, it is especially preferable that the number of the chelating groups are either equal to that of the alkoxy group or less. By doing this the residual potential may especially be restrained to a small level.

For the metal in the organic metal compound, zirconium, titanium and aluminium are especially preferable. Other metal compounds include various practical problems, for example, they are lacking in versatility, method of syntheses have not yet been established; cost is high; electro-potential properties and image properties are insufficient.

Further, among the above-mentioned zirconium, titanium and aluminium. Zirconium has a practical disadvantage that precipitation tends to be caused with the lapse of time of the coating solution after preparation thereof. In this respect, coating solutions of titanium and aluminium have an advantage that they are superior in stability and, therefore, preferable.

Among organic metal compounds which are advantageously used in the present invention, titanium chelating compounds containing an acetoacetate chelate ligand include, for example as follows.

diisopropoxytitaniumbis(methyl acetoacetate),
diisopropoxytitaniumbis(ethyl acetoacetate),
diisopropoxytitaniumbis(propyl acetoacetate),
diisopropoxytitaniumbis(butyl acetoacetate),
dibutoxytitaniumbis(methyl acetoacetate),
dibutoxytitaniumbis(ethyl acetoacetate),
triisopropoxytitanium(methyl acetoacetate),
triisopropoxytitanium(ethyl acetoacetate),
tributoxytitanium(methyl acetoacetate),
tributoxytitanium(ethyl acetoacetate),
isopropoxytitaniumtri(methyl acetoacetate),
isopropoxytitaniumtri(ethyl acetoacetate),
isobutoxytitaniumtri(methyl acetoacetate),
isobutoxytitaniumtri(ethyl acetoacetate);

As for titanium chelating compounds having a β-diketone chelate ligand, for example, diisopropoxytitaniumbis(acetylacetodionate),
diisopropxytitaniumbis(2,4-heptane dionateO,
dibutoxytitaniumbis(acetylacetonate),
dibutoxytitaniumbis(2,4-heptanedionate),
tributoxytitanium(acetylacetonate),
tributoxytitanium(2,4-heptanedionate),
isopropoxytitaniumtri(acetylacetonate),
isopropoxytitaniumtri(2,4-heptanedionate).
isobutoxytitaniumtri(acetylacetonate),
isobutoxytitaniumtri(2,4-heptanedionate);

As for aluminium chelating compounds having an acetoacetate chelate ligand, for example, diisopropoxyaluminium(methyl acetoacetate),
diisopropoxyaluminium(ethyl acetoacetate),
diisopropoxyaluminium(propyl acetoacetate),
diisopropoxyaluminium(butyl acetoacetate),
dibutoxyaluminium(methyl acetoacetate),
dibutoxyaluminium(ethyl acetoacetate),
isopropoxyaluminiumbis(methyl acetoacetate),
isopropoxyaluminiumbis(ethyl acetoacetate),
isobutoxyaluminiumbis(methyl acetoacetate),
isobutoxyaluminiumbis(ethyl acetoacetate);

As for aluminium chelating compounds having β-diketone chelate ligand, for example, diisopropoxyaluminium(acetylacetonate),
dibutoxyaluminium(2,4-heptanedionate),
dibutoxyaluminium(acetylacetonate),
dibutoxyaluminium(2,4-heptanedionate),
isopropoxyaluminiumbis(acetylacetonate),
isopropoxyaluminiumbis(2,4-heptanedionate),S
isobutoxyaluminiumbis(acetylacetonate),
isobutoxyaluminiumbis(2,4-heptanedionate);

etc. can be mentioned, however, the scope of the present invention is not limited to these.

Hereinbelow, preferable zirconium compounds are given.

First, as for zirconium chlating compounds having acetoacetate chelate ligand, for example, diisopropoxyzirconiumbis(methyl acetoacetate),
diisopropoxyzirconiumbis(ethyl acetoacetate),
diisopropoxyzirconiumbis(propyl acetoacetate),
diisopropoxyzirconiumbis(butyl acetoacetate),
dibutoxyzirconiymbis(methyl acetoacetate)
dibutoxyzirconiumbis(ethyl acetoacetate),
triisopropoxyzirconium(methyl acetoacetate).
triisopropoxyzirconium(ethyl acetoacetate),
tributoxyzirconium(methyl acetoacetate),
tributoxyzirconium(ethyl acetoacetate),
isopropoxyzirconiumtri(methyl acetoacetate),
isopropoxyzirconiumtri(ethyl acetoacetate),
isobutoxyzirconiumtri(methyl acetoacetate),
isobutoxyzirconiumtri(ethyl acetoacetate);

As for zirconium chelating compounds having β-diketone chelating group, for example, diisopropoxyzirconiumbis(acetylacetonate),
diisopropoxyzirconiumbis(2,4-heptanedionate), dibutoxyzirconiumbis(acetylacetonate), dibutoxyzirconiumbis(2,4-heptanedionate), triisopropoxyzirconium(acetylacetonate), triisopropoxyzirconium(2,4-heptanedionate)Is tributoxyzirconium(acetylacetonate), tributoxyzirconium(2,4-heptanedionate), can be mentioned, however, the scope of the present invention is not limited to these.

These compounds are mentioned as examples, which are particularly advantageous to attain the objectives of the present invention, and there are lots of other compounds known in the art, with which the objectives of the present invention are also attainable.

The silane coupling agent, which is another essential component for the formation of the interlayer according to the invention, is a compound represented by the following formula 2.

$$(Z)_a(A)_bSi(Y)_c.$$

In the above formula, Z represents a hydrolysable group, such as a halogen atom, an alkoxy group or an amino group; A represents an alkyl group or an aryl group; and Y represents an organic functional group capable of coupling; a and c independently represent an integer of 1 to 3; b represents an integer of 0 to 2; provided that the sum of a, b and c is 4. It is preferable that c is 1 and a is 2 or more.

In the known publications, for example, in Japanese Patent O.P.I Publication No.4-247461(1992), alkoxy groups such as methoxy group, ethoxy group, propoxy group and butoxy group are mentioned for Z, alkyl groups such as methyl, ethyl, propyl and butyl and aryl groups such as phenyl group are mentioned for A and the following groups are mentioned as the terminal group of the organic functional group:

1) $CH_2{=}C(CH_3)COO{-}$

2) 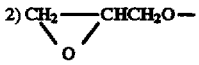

3) 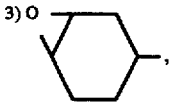 ,

4) $-NH_2$,

5) $NH_2CH_2CH_2NH-$,

6) HS—,

7) Cl—

Excellent properties in the film-forming performance, image quality and electro-potential properties can be obtained when the terminal group of the organic functional group Y is methacryloxy group or an amino group.

The methacryloxy group is a group represented by $CH_2{=}C(R')COO-$, wherein R' is an alkyl group, preferably an alkyl group having three or less carbon atoms. Specific examples of the silane coupling agent having the methacryloxy group are as follows:

γ-methylmethacryloxypropyltrimethoxysilane,

γ-methylmethacryloxypropyltriethoxysilane,

γ-methylmethacryloxypropyltrimethoxysilane,

γ-methylmethacryloxypropylmethoxydimethoxysilane,

γ-methylmethacryloxypropylmethoxydiethoxysilane.

However, the scope of the present invention is not limited to these.

By the use of the silane coupling agent having these methacryloxy group, an interlayer excellent in both film-forming performance and image properties can be obtained. What is worthy of special mention concerning the silane coupling agent having the end methacryloxy group, is stability of electro-potential. An interlayer can be obtained which has extremely stable potential properties such as low residual potential even when the repeated copying operation was carried out.

Among the above-mentioned silane coupling agent, those which show excellent properties have a methacryloxy group or an amino group, i.e., an $-NH_2$ group or an —NHR" group at the terminal of the organic functional group Y. In the above, R" represents an alkyl group or an aryl group, and, preferably, an alkyl group having six or less carbon atoms or an aryl group containing eight or less carbon atoms.

The silane coupling agent having this amino group at the end thereof, is more reactive than other silane coupling agents which do not have this structure, and network structuring in the interlayer tends to proceed more rapidly by polymerization with a metal compound during formation of the interlayer. It is assumed that this high reactivity greatly contributes to the restriction of the image defects, more specifically, white spots or black spots, and, in this respect, this type of silane coupling agents came to have superior properties to many other silane coupling agents.

Among these, primary and secondary amino groups show very high reactivity and primary amino group $-NH_2$ shows praticylarly high reactivity. Accordingly, they have excellent image defect-restraining ability.

As for specific examples of the organic functional group having an $-NH_2$ group at the terminal portion thereof, for example, γ-aminopropyl group, γ-aminoethyl group, γ-aminobutyl group, can be mentioned and for the silane coupling agents having this organic functional group, for example, γ-aminopropyltrimethoxysilane, γ-aminopropyltriethoxysilane, γ-aminopropylmethyldimethoxysilane, γ-aminopropylmethyldiethoxysilane, can be mentioned. However, the scope of the present invention is not limited by these.

As for the structure of the organic functional group other than the terminal group thereof, there is no specific limitation. Other than the alkylene group or $-(CH_2)_n-$ group above-mentioned, an alkylene group containing a different kind of structuring unit, for example, an imino group, a carbonyl group and oxygen, such as a $-(CH_2)_m-NH-(CH_2)_n-$ group and a $-(CH_2)_n-NH-CO-$ group in which m and n are preferably integers of ten or less.

This organic functional group includes, for example,

N-β-(aminoethyl)-γ-aminopropyl group,

N-β-(aminopropyl)-γ-aminopropyl group,

N-β-(aminoethyl)-γ-aminobutyl group,

γ-ureidopropyl group, can be mentioned, and as for the silane coupling agent having this organic functional group, for example, N-β-(aminoethyl)-γ-aminopropyltrimethoxysilane N-β-(aminoethyl)-γ-aminopropyltriethoxysilane N-β-(aminoethyl)-γ-aminopropylmethyldimethoxysilane N-β-(aminoethyl)-γ-aminopropylmethyldiethoxysilane N-β-(aminopropyl)-γ-aminopropyltrimethoxysilane N-β-(aminoethyl)-γ-aminobutyltrimethoxysilane γ-ureidopropyltrimethoxysilane, γ-ureidopropyltriethoxysilane, can be mentioned. However, the scope of the present invention is not limited to these.

In the case where a photoreceptor is loaded on an image forming apparatus with high line speed and is used repeatedly, excellent potential properties such as high sensitivity with less increase in the residual potential is obtainable when it consists only of an aliphatic hydrocarbon chain or a $-(CH_2)_n-$ group.

As the aliphatic or aromatic hydrocarbon group, which is introduced to the amino group, for example, alkyl group such as methyl group, ethyl group, propyl group and butyl group; a residue of an unsaturated aliphatic hydrocarbon group such as a vinyl group and an allyl group; an aryl group such as phenyl group, toluyl group, xylyl group and naphthyl group can be mentioned as examples, however the scope of the present invention is not limited to these. Moreover, these groups may be substituted by any one of these groups.

For the organic functional group having a secondary amino group at the terminal portion, for example, N-methyl-γ-aminopropyl group, N-ethyl-γ-aminopropyl group, N-vinyl-γ-aminopropyl group, N-allyl-γ-aminopropyl group, N-phenyl-γ-aminopropyl group, N-toluyl-γ-aminopropyl group, can be mentioned, and as the silane coupling agent having this organic functional group, for example, N-methyl-γ-aminopropyltrimethoxysilane, N-ethyl -γ-aminopropyltrimethoxysi lane, N-vinyl-γ-aminopropyltrimethoxysilane, N-allyl-γ-aminopropyltrimethoxysilane, N-phenyl-γ-aminopropyltrimethoxysilane, N-toluyl-γ-aminopropyltrimethoxysilane, can be mentioned. However, the scope of the invention is not limited to these.

These compounds are listed because the objectives of the present invention can be attained at the high standard of level, and there are lots of other compounds, with which objectives of the present invention may be achieved.

In the present invention the interlayer comprises at least one above-mentioned organic metal compound and at least, one silane coupling agent, respectively, and, if necessary it can comprise another kind or kinds of compounds or two or more of the above-mentioned compounds in combination.

Moreover, if necessary, other compounds such as resin may be incorporated at required quantity.

Among the interlayers according to the above, ones giving a specific infrared absorption spectrum is most preferable. The specific infrared absorption spectrum of the preferable interlayer is characterized in that: the peak ratio (b/a), hereinafter referred to as IR peak ratio, of the maximum value of absorption within the range of 1580 to 1650 $cm^{-1}$ (b) to that within the range of 2900 to 3000 $cm^{-1}$ (a) is 0.5 to 10. The infrared absorption spectrum or the above ratio of b/a of the interlayer is varied depending on kinds and mixture ratio of the compositions thereof, and drying condition of the layer after coating. It is preferable, for obtaining an interlayer excellent in the layer-forming property, image forming characteristics and electrifying property, to control the above conditions so that the b/a ratio of infrared absorption spectrum of the layer falls within the range of from 0.5 to 10.

An interlayer having an IR peak ratio less than 0.5 shows a tendency to be fragile and apt to form a crack which causes a image defect such as a white or black spot. However, such defect almost does not form and any problem is not actualized in practical use even when the peak ratio is less than 0.5 as far as the interlayer satisfies the foregoing relation between the surface roughness of substrate and the thickness of interlayer. When the IR peak ratio is not less than 0.5, particularly excellent image having no white or black spot at all.

When the IR peak ratio is more than 10, the interlayer shows a tendency to deteriorate in the blocking property and in the adhesion property to the photoconductive layer to be provided on the interlayer.

The value IR peak ratio of the interlayer can be fallen near or within the above preferable range or by controlling the composition or layer making condition of the interlayer.

When an inter layer is made by using a combination of an organic metal compound and a silane coupling agent, several kinds of samples of the interlayer in which the ratio of one of the components is varied 0 to 100% and the IR peak ratio of each sample is measured. Thus, the ratio of the components given an IR peak ratio within the preferable range can be selected. By this method a composition of the interlayer having a good property can be easily and certainly selected by evaluation only on the samples of interlayer without any necessity to prepare complete photoreceptor samples.

Further, the IR peak ratio can also be controlled by changing the layer-making condition, i.e., temperature or time of ht elayer after coating thereof. The value IR peak ratio is lowered when the layer is dried at a higher temperature and a longer time, and is raised when the layer is dried at a lower temperature and a shorter time.

If the IR peak ratio cannot be fallen within the range of the above preferred range by the above-mentioned adjustment in the preparation conditions, the selection of the components is to be reconsidered. In such case, however, a photoreceptor acceptable for practical use can be obtained as far as the ten point mean roughness of the surface of electroconductive substrate $R_z$ and the thickness of interlayer L satisfy the relation of the present invention.

The IR peak ratio is measured by the following method. The infrared absorption spectrum of a sample is measured by an infrared spectrometer. When the substrate of the sample is an opaque material such as a metal, the measurement is carried by reflected light. The measured results are calibrated with respect to a base line or zero line which is a line connecting the points on the spectrum at 4000, 3800, 2500, 1800 and 800 $cm^{-1}$. Further, the infrared absorption of the substrate is subtracted from the above measured value to obtain the infrared absorption of the interlayer itself. A value absorption at the maximum peak of the infrared absorption spectrum being within the range of 1580 to 1650 $cm^{-}$(b) and that of the maximum peak being within the range of 2900 to 3000 $cm^{-1}$ (a) are determined and the peak ratio b/a is calculated. As the sample for measuring the infrared absorption, an interlayer before coating of a photosensitive layer and an interlayer remaining after wipe off a photosensitive layer with an appropriate solvent can be either used. The results of the above two kinds of the sample are almost the same.

Thus, an interlayer having sufficient properties necessary to suffice the objectives of the present invention is obtained.

In order to maintain images having excellent contrast and resolving power even when the photoreceptor is mounted in an image-forming apparatus with high line speed and repeatedly used for a long period of time, a CGM having high sensitivity with excellent properties and stability during continuous and repeated use is necessary. An imidazoleperylene compound can be mentioned as the most preferable CGM in the light of high sensitivity and high resolving power.

The imidazoloperylene compound, which is advantageously usable in the present invention has either one of the following chemical structures.

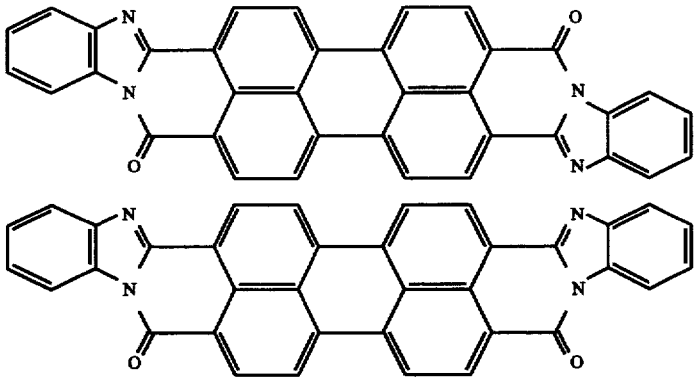

Figure 6:
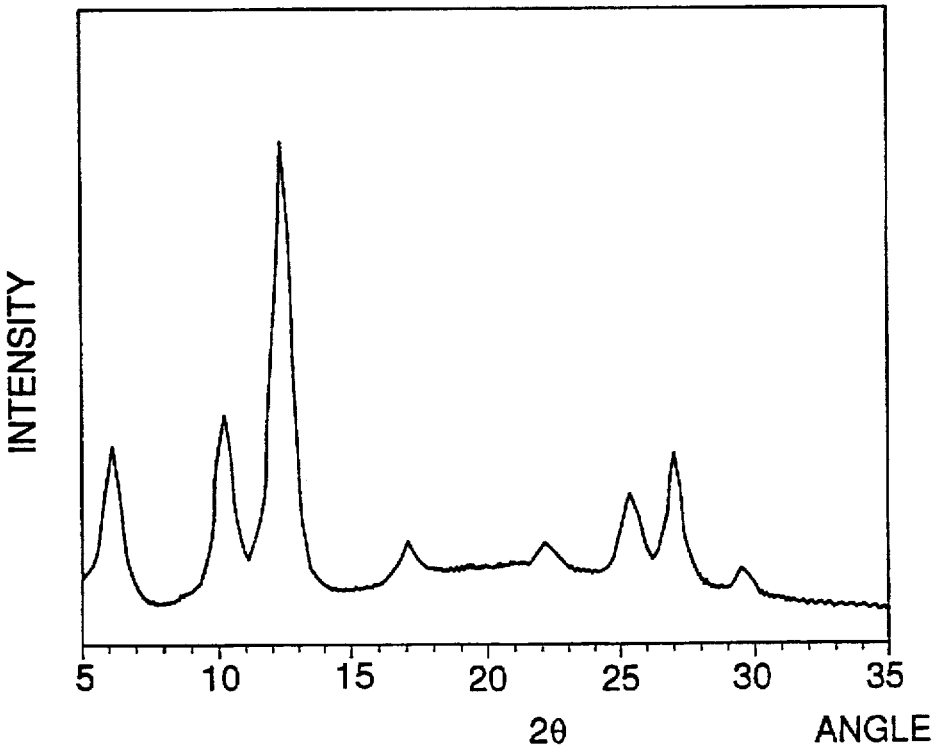
FIG. 6: X-ray diffraction spectrum of imidazoloperylene compound relating to the invention

Among the imidazoleperylene compounds, one being in a crystal form which shows a Cu-Kα X-ray diffraction spectrum having peaks at Bragg angle 2θ of 6.3°±0.2°, 12°±0.2°, 25.3°±0.2° and 27.1°±0.2°, in which the peak at 12.4°±0.2° is highest and the half value width of its is not more than 0.65°, and has no obvious peak at 11.5°±0.2° in the X-ray diffraction spectrum is particularly preferable (cf. FIG. 6). Carrier generating ability of a CGM is dependent not only on the molecular structure of the CGM but also on state of aggregation of the molecules or, for example, crystal structure. An imidazoleperylene compound having a crystal structure, which gives the above-mentioned X-ray diffraction spectrum, is preferable as the CGM capable of showing high carrier generation ability and other properties.

Concerning the crystal form of the imidazoleperylene compound, α-, γ-, ε- and ρ-type are known. The above-mentioned crystal form can be obtained by dispersing the ρ-type imidazoloperylene to make it to fine particles. As the method for making the fine particles, for example, the following method can be applied: imidazoleperillene purified by sublimation is subjected to an acid-past treatment with sulfuric acid (for making amorphous or lowering crystallinity) and the treated matter is quietly dispersed in an organic solvent having a high affinity in the presence of a polymer binder to growing crystals. By the above method, uniform fine particles can be formed and deterioration in the photographic property caused by forming crystal defects can be avoided because mechanical impact given to the particles is small.

In order for the photoreceptor to have sufficient sensitivity to light of longer wavelength region, it is necessary for the CGM to have capability of generating carriers faithfully responding to small difference of light exposure. Thus images with excellent contrast and resolving power may be produced. Taking these various properties into account, in the present invention, titanylphthalocyanine which may be hereinafter abbreviated to TiOPc is most appropriate as CGM.

Basic structure of the TiOPc hs represented by the following formula.

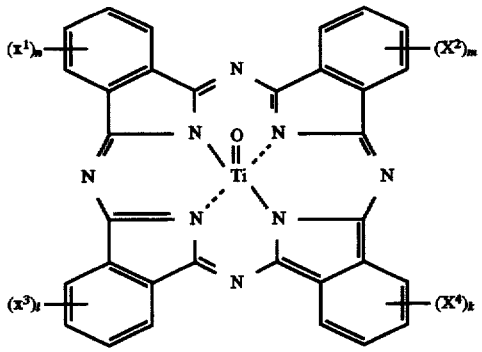

in the formula, $X^1$, $X^2$, $X^3$ and $X^4$ independently represent a hydrogen atom, a halogen atom, an alkyl group or an alkoxy group; and n, m, l and k independently represent an integer of 0, 1, 2, 3 or 4.

It is preferable that $X^1$, $X^2$, $X^3$ and $X^4$ are all hydrogen atoms.

Further as this TiOPc, one being in a crystal form giving a Cu-Ka X-ray diffraction spectrum which has peaks at Bragg angle 2θ of 9.6°±0.2°, 11.7°±0.2°, 15.0°±0.2°, 24.1°±0.2° and 27.2°±0.2° is particularly preferable.

With respect to the crystal form of the TiOPc, A-, B- and Y-type have been known, and the above-mentioned crystal type is a Y-type TiOPc, which shows very high carrier generation ability compared with the crystals of the other forms. And because of this excellent properties, this is mentioned to be particularly preferable.

Thus the photoreceptor comprising the above-mentioned imidazoleperylene compound or titanylphthalocyanine compound can exert satisfactory performance with respect to contrast or resolving power even when it is mounted in a copying machine with high line speed or a semiconductor laser printer.

However in the case of the resinous interlayer, problems concerning images such as tiny image defects, such as white spots and black spots, or transfer memory, have not been dissolved.

The reason why the image defects were overcome by the present invention in the light of principle of electrophotography is considered to be as follows. According to the principle of the electrophotography, when an organic photoreceptor, the surface of which was charged in the negative polarity by means of corona discharge, was exposed to light, holes and electrons are generated, and the thus generated holes neutralize the negative electrons on the surface to form a electrostatic latent image on the surface corresponding to the amount of light irradiation. Accordingly, if holes are injected from the electroconductive substrate, electric potential of the surface of the negatively charged photoreceptor is similarly lowered to cause image defects or fogging.

Particularly, in the highly sensitive CGM such as imidazoleperylene or titanylphthalocyanine, holes are liable to be injected from defects or stains of the electroconductive substrate, and forms image defects, i.e., white spots in the case of the normal development, and black spots in the case of reversal development). Particularly in the case of reverse development, influence of defect is large because black spots are formed in the white background. In order to prevent this, formation of a uniform film is one of essential requirements of the interlayer. In the case where resinous interlayer is used, function to restrict this sort of defects is insufficient. Further in the case of the ceramic interlayer, when it is applied with relatively a thin layer, blocking of the whole injection is insufficient and application with certain thickness is necessary. However, by increasing thickness of the ceramic interlayer, cracks may be caused easily and it was often the case that white spots and black spots are also liable to form more frequently, and it has been difficult to find out an appropriate domain. This problem can be solved by controlling the shape of the surface of the substrate and, more specifically, by controlling surface roughness of the substrate and the thickness of the interlayer to fall within the most appropriate domainn and particularly excellent performance can be obtained by optimizing the constituent materials of the interlayer.

Further, apart from this sort of local defects, as a defect which is particular to reversal development, a web-shaped fogging, which occurs in the place where no paper sheet was formerly present, i.e., transfer-trace fogging or transfer fogging, is known in the art. This is caused by transfer process. The transfer process is a stage, where toner on the electrostatic latent image formed on the surface of the photoreceptor is transferred onto a paper and this is usually carried out by conducting corona discharge from rear side of the paper. On this occasion, a potion of the photoreceptor is directly exposed to corona discharge.

Usually, in the normal development conducted in a copying machine, transfer charge in the same polarity as in the electrification stage is showered and, accordingly no similar problem takes place. However in the reverse development and in the case when a negatively chargeable photoreceptor is used, because image-transfer is carried cut with positive electrification, when the surface of the photoreceptor is directly exposed to the corona discharge, negative charge is induced inside the photoreceptor due to positive charge generated in that portion. When the next electrification (negative electrification) is restrained without neutralizing this negative charge, sufficient electrification potential cannot be obtained in the portion, where there was no paper at the time of the former transfer process, and this turns out to be the web-formed fogging. In order to prevent this problem, it is necessary for the interlayer to acquire properties to block the holes and, at the same time, to leak out electrons. Accordingly, in the photoreceptor for a laser printer, with which reversal development is carried out using a highly sensitive material like titanylphthalocyanine, the interlayer is required to work as an insulator for the holes and conductor for the electrons. In other words, properties as an N-type semi-conductor are required. It is difficult for a resinous interlayer to possess these properties and, in addition, transfer-trace fogging should not be restrained in the case of a polyamide resin which is popularly employed in the art.

The ceramic type interlayer is superior in this property, and, particularly, those which are listed as the most appropriate materials in this description are capable of showing the property at more excellent level. The inventors paid attention to the roughness of the substrate and have succeeded in putting the ceramic-type interlayer into practice as an interlayer capable of solving the above-mentioned problems at sufficient level. by realizing stable film forming performance.

The interlayer according to the present invention is produced by coating a solution, formerly referred to as a coating solution, which contains the component materials, i.e., an organic metal compound and a silane coupling agent, dissolved in a solvent, drying and hardening it As the solvent, for example, alcohols such as methanol, ethanol propanol and butanol; an aromatic hydrocarbons such as toluene; and esters such as ethyl acetate cellosolve acetate can be mentioned, however, the scope of the invention is not limited to these. These solvents can be used either singly or two or more kinds in combination. Further, if necessary, they can be mixed with water.

As for the method of coating the coating solution, for example, a dipping-coating method, a spray-coating method, a blade-coating method, a spinner coating method, a bead coating method and a curtain coating method can be used.

Drying conditions of the coated layer are, usually between 10° and 250° C. and, more preferably, between 90° and 200° C. with respect to drying time, and usually between 5 minutes and 5 hours and, more preferably between 20 minutes and 2 hours with respect to the drying period; and the drying may be performed either under ventilated or non-ventilated condition.

A photoconductive layer is usually provided on the interlayer. The photoconductive layer may consist of a single-layer structure or a laminated multi-layer structure.

In the case of the single-layer structure, a photoconductive layer, in which charge generation substances is dispersed in charge transportation substance, can be mentioned.

In the case of the laminated multi-layer structure, a function separation type photoreceptor comprised of a carrier generation layer and a carrier transportation layer can be mentioned to be typical. Order of lamination of the carrier generation layer and the carrier transportation layer on the electroconductive substrate is optional. However, in order for the respective objectives of the present invention to be attained at an enhanced level, a negative electrification-type photoreceptor, in which the carrier transportation layer is laminated on the carrier generation layer is preferable.

The charge transportation layer is formed by, if necessary distributing a charge generation material(CGM) in a resin. As for such CGM, for example, inorganic photoconductive materials such as selenium or alloys thereof, CdS, CdSe, CdSSe, ZnO, ZnS, metal or non-metal phthalocyanine compounds; azo compounds such as bisazo compounds, trisazo compounds, such as squarium compounds, azurenium compounds, perylene compounds, indigo compounds, quinacridone compounds, polyquinone-type compounds, cyanine dyes, xanthene dyes and transportation complexes composed of poly-N-carbazoles and trinitrofluorenone can be mentioned. However, the scope of the present invention is not limited to these. Moreover, these compounds may be used either individually or two or more kinds in combination. In order for the objectives of the present invention to be achieved at. the most enhanced level, as mentioned above, a kind of perylene compounds, imidazoleperylene compounds, metallic phthalocyanine compounds(TiOPc) are preferable. Particularly, for the purpose of attaining the objectives of the of the present invention, imidazoloperylene compounds, and TiOPc are especially preferable CGMs.

As for binder resins which are applicable in the carrier generation layer, for example, polystyrene resins, polyethylene resins, polypropylene resins, acryl resins, methacryl resins, vinyl chloride resins, vinyl acetate resins, polyvinyl butyral resins, epoxy resins, polyurethane resins, phenol resins, polyester resins, aLkyd resins, polycarbonate resins, silicone resins, melamine resins, and copolymer resins containing two one more repeating unit of the abaovementioned resins, for example, vinyl chloride-vinyl acetate copolymer resins, vinyl chloride-vinyl acetate-maleic acid anhydride copolymer resin; polymeric organic semiconductors such as poly-N-vinyl carbazoles can be mentioned, however, again, the scope of the present invention is not limited to these. Among the above-mentioned compounds, as particularly preferable resin when an imidazoleperylene compound is used as CGM, polyvinyl butyral resins, and silicone resins, polyvinyl butyral reins and a mixture of these resins when a TiOPc is used, can be mentioned.

The carrier transportation layer is constructed either singly with a carrier transportation material(CTM) itself or with CTM together with a binder resin. As for the CTM, for example, carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline derivatives, oxazolone derivatives, benzimnidazole derivatives, quinazoline derivatives, benzofurane derivatives, acrydine derivatives, phenadine derivatives, aminostilbene derivatives, triarylamine derivatives, phenylenediamine derivatives, stilbene derivatives, benzidine derivatives, poly-N-vinylcarbazoles, poly-1-vinylpyrene, poly-9-vinylanthrathene can be mentioned, however the scope of the invention is not limited to these. Further, these compounds may be used either individually or two or more compounds in combination.

Further, for the resin which is applicable to the carrier transportation layer, for example, polycarbonate resins, polyacrylate resins, polyester resins, polystyrene resins, styrene-acrylonitrile copolymer resins, polymethacrylate resins, styrene-methacrylate copolymer resins can be mentioned. However the scope of the present invention is not limited to these.

In order to reduce fatigue of the photoreceptor when it is subjected to continuous repeated use, or for the purpose of improving durability, conventionally known anti-oxidants, ultraviolet-ray absorbents, electron receptive materials, the surface modifiers, oplasticizers, anti-environment-dependence reducing agent may optionally be incorporated in any of constituent layers of the photoreceptor at an appropriate quantity.

Further, for the purpose of improving durability, if necessary, a non-light-sensitive layer such as a protective layer may optionally be arranged other than the photoconductive layer.

As mentioned above, the photoreceptor according to the present invention comprising the ceramic interlayer is capable of exerting its effects in the image-forming processes, which include reverse development process such as in printers or digital copiers.

Next, process of the present invention is explained with reference to a digital copier which is shown in FIG. 1 and in which the image-forming process is employed.

In the image-forming apparatus illustrated in FIG. 1, reflected light from a original document is color separated and focused on CCD in the image reading section 2 The light information received by the CCD is then converted into electric signals and the image data are sent to an image-writing section 3.

On the other hand, photoreceptor drum 1, which is in charge of image formation is uniformly electrified by a electrification unit 4 with corona discharge, and consequently, imagewise light exposure is conducted on the photoreceptor drum 1 from a laser light source of the image writing section 3, and electrostatic latent image formed on the photoconductive drum 1 is reversely developed with a developing unit 5, to form a toner image on the light exposed portion. In the case of a color image-forming apparatus as illustrated in this example, processes of electrification, image writing with laser light and development with corresponding color toner are repeated with respect to the separated color, and yellow, magenta, cyan and black toner images are formed on the photoreceptor.

The four color toner images are transferred at a time onto a recording paper. The recording paper is separated from the photoreceptor drum by a separation electrode 7 and the image is fixed by a fixing unit 8. The photoreceptor drum is, on the other hand, cleaned in a cleaning apparatus 9.

In the above-mentioned example, the process of four-color toner image formation is explained, however, if the situation so requires, toner image consisting of different number of toner image such as a monochromatic toner image or a dichromatic toner image may be formed.

Moreover, concerning the method of the toner image formation or the method of transfer onto the recording paper, a different method may also be applied.

Still further, in addition to the above, image information may be memorized in an image memory such as ROM, floppy disk in advance and the image information may be taken out from the image memory depending necessity, and outputted to the image forming section. Accordingly, the image formation process according to the present invention includes apparatuses, in which as in the present example, there is no image-reading section and information is stored in a memory from a computer and the information is outputted in the image forming section is included within the scope of the image formation process according to the present invention. As the most popular example of such image formation process, LED printers or LBP (laser beam printer) can be mentioned.

EXAMPLES

Hereinbelow the present invention is explained more in detail with reference to working examples, however embodiments of the present invention are not limited to these.

[Example 1]

<Interlayer>

| | |
|---|---|
| Organic metal compound (Exemplified compound A3*) | 140 g |
| Silane coupling agent (B1) | 60 g |
| Isopropyl alcohol | 2000 ml |
| Ethyl alcohol | 500 ml |

*: Hereinafter exemplified compounds are simply referred such as (A3). The chemical structures of the exemplified compounds are described later.

The above-mentioned composition was stirred by a stirrer to prepare a coating solution of interlayer. The coating solution was coated within the same day on aluminum substrates each having a different surface roughness as shown in Table 1 by an immersing coating method and dried at 100° C. for 30 minutes. The thickness of the coated interlayers were controlled so as to be those listed in Table 1. In the table, symbol + shows that a sample was prepared, which has a combination of the layer thickness and the surface roughness given in the line and column of the table corresponding to the portion of the symbol.

Accordingly, the interlayers were prepared under 72 kinds of conditions which include combinations of eight levels of surface roughness of the substrate and nine levels of thickness of the inter layer. The measurment of the surface roughness was carried out by a surface roughness meter Surfcorder SE-30H (Kosaka Kenkyuusho Co.) in P-profile.

TABLE 1

Preparation condition of interlayer of photoreceptor

| Thickness of interlayer (μm) | Rmax (Rz) (μm) 0 (0) | 0.3 (0.3) | 0.5 (0.5) | 1.0 (0.9) | 2.1 (2.0) | 3.0 (2.9) | 4.1 (4.0) | 4.6 (4.5) |
|---|---|---|---|---|---|---|---|---|
| 0.25 | + | + | + | + | + | + | + | + |
| 0.35 | + | + | + | + | + | + | + | + |
| 0.5 | + | + | + | + | + | + | + | + |
| 1.0 | + | + | + | ++ | + | + | + | + |
| 2.0 | + | + | + | + | + | + | + | + |
| 3.0 | + | + | + | + | + | ++ | + | + |
| 4.0 | + | + | + | + | + | + | + | + |
| 5.0 | + | + | + | + | + | + | + | + |
| 6.0 | + | + | + | + | + | + | + | + |

Examples 1, 2, 18 and 19 were each carried out under all combinations of the above described conditions (72 kinds) shown with + and ++. Examples 3 to 17 were carried out under the two conditions shown with ++ in the above table.

| <Carrier generating layer > | |
|---|---|
| Carrier generating substance (C1) | 40 g |
| Polyvinylbutyral resin (Elex BM-S Sekisui Kagaku Co.) | 15 g |
| Methylethylketone | 200 ml |

The above-mentioned composition was dispersed by a sand mill to prepare a coating liquid of carrier generating layer. The coating liquid was coated on the interlayer by an immersion coating method to form a carrier generating layer having a thickness of 0.5 μm.

| <Carrier transportating layer> | |
|---|---|
| Carrier transportating substance (D1) | 200 g |
| Bisphenol Z type polycarbonate resin (Europin Z 300, Mitubish Gas Kagaku Co.) | 300 g |
| 1,2-dichloroethane | 2000 ml |

The above-mentioned composition was stirred and dissolved to prepare a carrier transportating layer coating solution. The coating solution was coated on the above-prepared carrier generating layer by an immersion coating method so as to form a carrier transportating layer having a thickness of 20 μm.

Thus 27 kinds of photo-receptor were prepared. The conditions of each of these photo-receptor are listed in Table 2 together with the evaluation results thereof.

[Examples 2 to 14]

In Example 2, 27 kinds of samples were prepared in the same manner as in Example 1 except that the combination of organic metal compound (A3) and silane coupling agent (B1) was replaced by the combination shown in Table 4. In each of Examples 3 to 14, 2 kinds of samples were prepared each using a combination of the surface roughness of the aluminum substrate and the thickness of the interlayer shown by ++ in Table 1, combinations of the roughness $R_z$=0.9 μm and the layer thickness of 1.0 μm, and the roughness $R_z$=2.9 μm and layer thickness of 3.0 μm, the combinations are each referred to as preparing conditions-1 and -2, respectively. The combinations of the organic metal compound and the silane coupling agent used in Examples 3 to 14 were given in Table 4. Preparing conditions of the samples other than the above-mentioned were the same as in Example 1.

[Example 15]

Samples were prepared in the same manner as in Example 1 except that the carrier generating layer was replaced by the following composition.

| <carrier generating layer> | |
|---|---|
| Carrier generating substance (C2) (Imidazoloperylene compound obtained by the later-mentioned sublimation treatment and acid-past treatment) | 70 g |
| Polyvinylbutyral resin (Elex BL-S) | 15 g |
| Methylethylketone | 2500 ml |
| α-chloronaphthalene | 800 ml |

Figure 3:
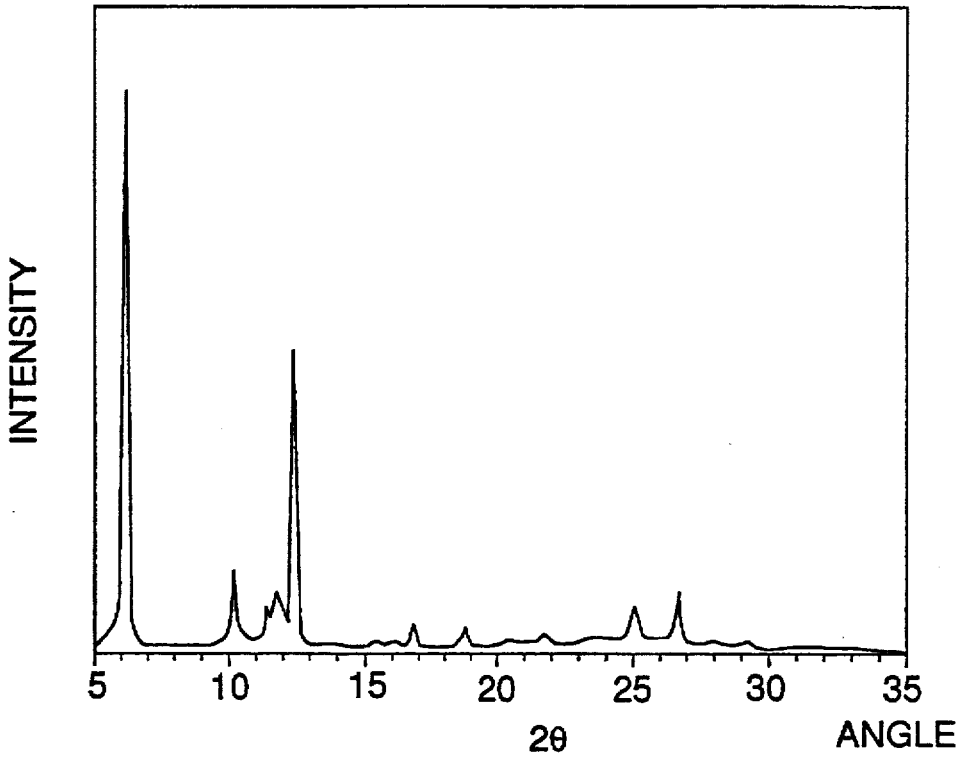
FIG. 3: X-ray diffraction spectrum of imidazoloperylene compound (Synthesized product) relating to the invention

The above-mentioned composition was mixed and reacted at 260° C. for 6 hours. After cooling, precipitates were filtered and washed repeatedly with methanol. The precipitates were dried by heating. Thus 51.1 g of imidazoloperylene compound was obtained which was a mixture of compounds (1) and (2) of the later mentioned C2. The X-ray diffraction spectrum of the synthesized compound is shown in FIG. 3.

| Compound No. 2 | |
|---|---|
| A1 | $(H_9C_4O)_4Ti$ |
| A2 | 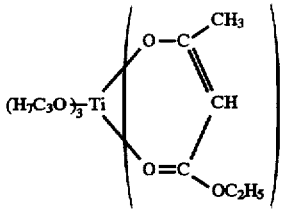 |
| A3 | 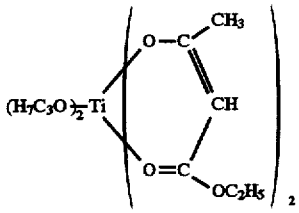 |
| A4 | 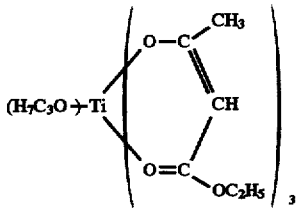 |
| A5 | 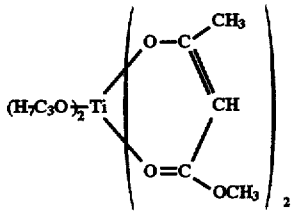 |
| A6 | 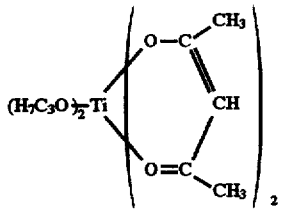 |
| A7 | 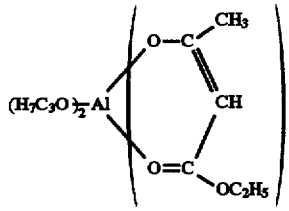 |
| A8 | 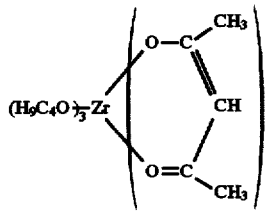 |

-continued
| Compound No. 2 | |
|---|---|
| A9 | 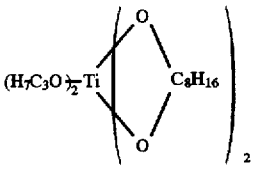 |
| A10 | 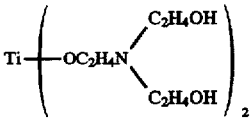 |
| B1 | 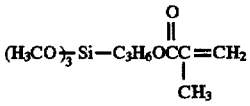 |
| B2 | $(H_3CO)_3Si-C_3H_6NH_2$ |
| B3 | $(H_3CO)_3Si-C_3H_6NHC_6H_5$ |
| B4 | $(H_3CO)_3Si-C_3H_6NHC_2H_4NH_2$ |
| B5 | 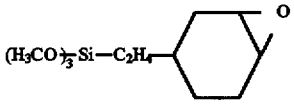 |
| C1 | 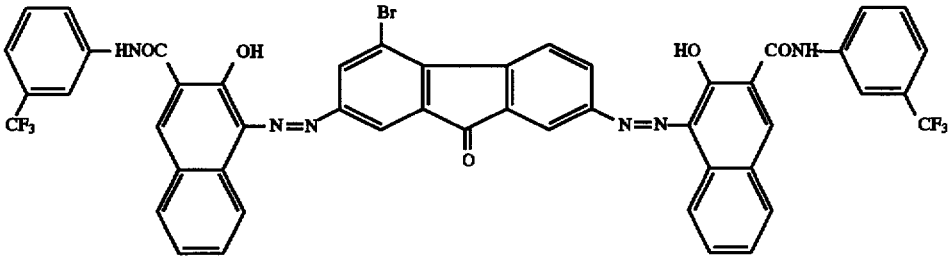 |
| C2 | 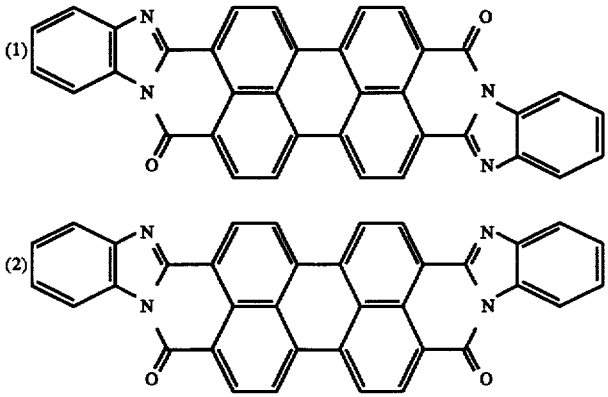 Mixture of (1) and (2) |

-continued

| Compound No. 2 | |
|---|---|
| C3 | 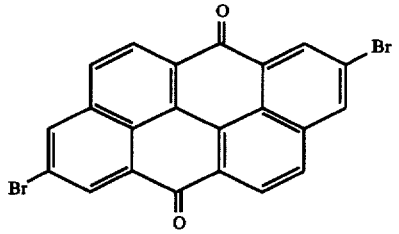 |
| C4 | 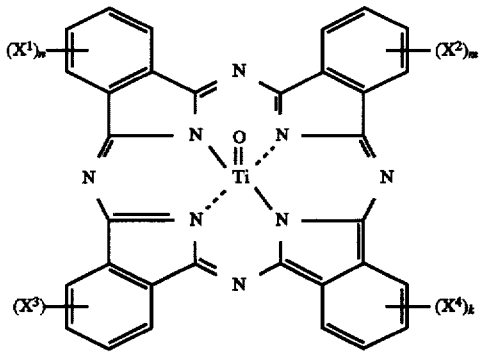 |
| D1 | 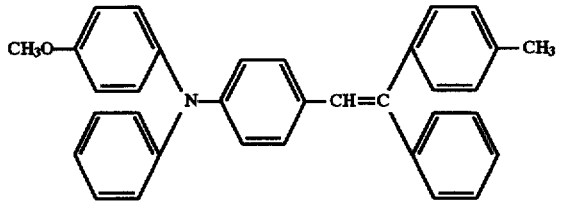 |

[Example of sublimation]

Figure 4:
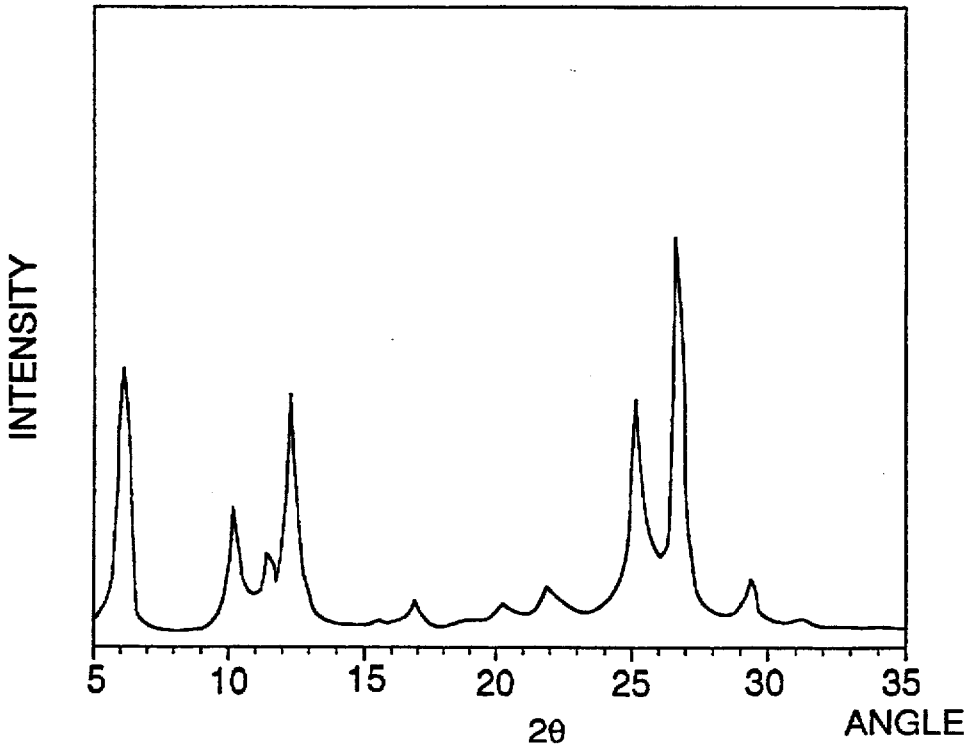
FIG. 4: X-ray diffraction spectrum of imidazoloperylene compound (sublimated product) relating to the invention

The imidazoloperylene compound obtained in synthesizing example 1 was purified by sublimation at 500° C. under a pressure of $5\times10^{-4}$ to $5\times10^{-3}$ torr. Non-volatile impurities were eliminated by a shutter. Thus obtained purified crystals were further purified by sublimation in the same manner as the above. The crystals purified by twice-sublimation was called as sublimated compound. The X-ray diffraction spectrum of the sublimated compound is shown in FIG. 4.

[Acid-past Treatment]

Figure 5:
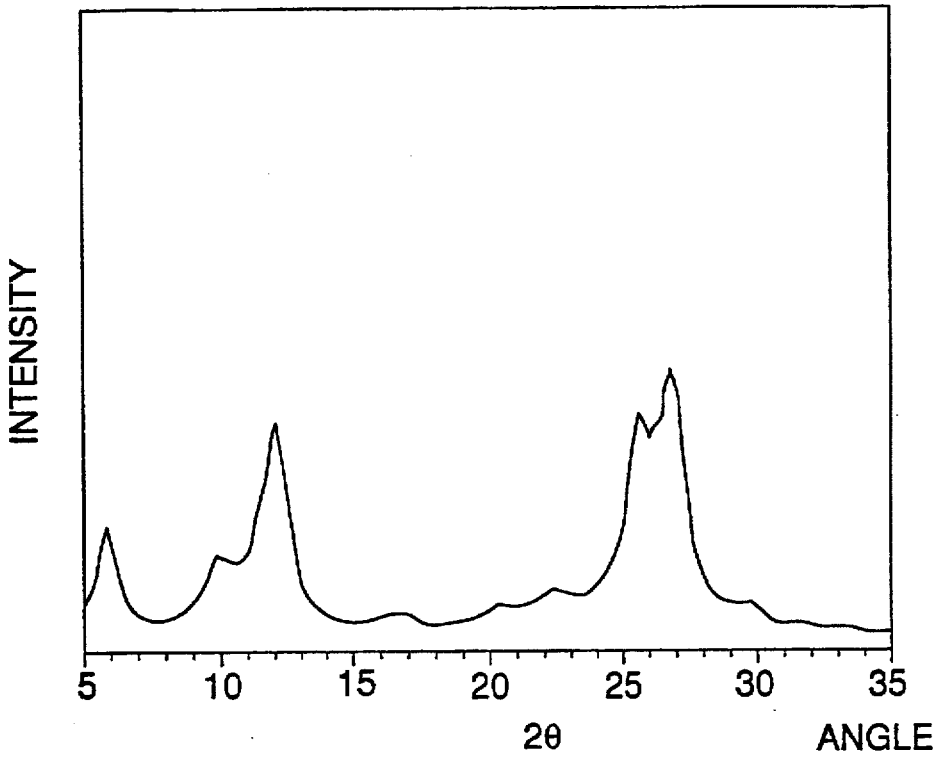
FIG. 5: X-ray diffraction spectrum of imidazoloperylene compound (AP product) relating to the invention

A solution composed of 20 g of the sublimated imidazoloperylene dissolved in 600 ml of concentrated sulfuric acid was filtered by a glass filter and dropped into 1200 ml of pure water to precipitate the inidazoloperylene compound. The precipitation was satisfactorily washed with pure water and dried. Thus obtained substance was called as AP compound or acid-past treated compound. The X-ray diffraction spectrum of the AP compound is shown in FIG. 5.

[Example 16]

Photoreceptors were prepared in the same manner as in Example 1 except that the carrier generating layer was changedby the following. One hundred grams of C3 and polybutyral resin (Elex BM-S, Sekisui Kagaku) and 2000 ml of methyl-ethylketone was mixed and dispersed in a sand mill for 10 hours. The dispersion was coated on the interlayer so that a carrier generating layer having a layer thickness 0.8 μm.

[Example 17]

Photoreceptors were prepared in the same manner as in Example 1 except that the carrier tansferring layer was changed by the following.

Sixty grams of polyamide resin (CM8000) was dissolved in 2000 ml of methanol and coated on aluminum substrates by an immersion coating method and dried at a room temperature to form an interlayer.

[Evaluation 1]

In the course of preparation of photoreceptors of Examples 1 and 2, degree of crack formation was visually observed at the time of coating and drying the interlayer.

The photoreceoptor on which whole layers were coated was mounted in a copying machine Konica U-BIX4045 produced by Konica Corporation and subjected to practical copying test. Thus obtained images were evaluated as to the following two items.

(1) Non-uniformity in a solid black image

Non-uniformity formed in a solid black copied image from an original (a black paper) having a reflective density of 1.3, which is caused by fine white spots formed in the image.

(2) Streak-like non-uniformity of density of a halftone image

Streak-like uniformity formed in a halftone image which is copied from an original having a reflective density of 0.3 (a halftone paper)

The non-uniformity of (1) is caused by cracks in the interlayer (including very small ones which hardly be confirmed visually) or insufficiency of blocking ability of the interlayer having a thickness too small. This type of defect is apt to generate under a high humidity and high temperature condition.

The non-uniformity of (2) is caused by insufficient cleaning of the substrate surface or nonuniformity in the thickness of the carrier generating layer (CGL). Both of the evaluations were carried out at a high temperature and high humidity condition of 30° C. and a relative humidity of 80%. The evaluation results were classified to three ranks.

For evaluation of item (1), the solid blackened image area was sectioned into squares of 1 cm×1 cm and number of the section including one or more white-spot having a diameter of not less than 0.3 mm was counted. The sample was classified according to the ratio of the number of sections including the white-spot to the number of the sections of the solid blackened image as follows:

Rank A: The ratio was not more than 1% (any white spot was hardly observed).

Rank B: The ratio was 1 to 10%

Rank C: The ratio was 10% or more

With respect to the evaluation item (2), the sample was classified according to the status of the streak-like density nonuniformity visually observed in the halftone image as follows:

Rank A: The streak hardly observed

Rank B: The streak was slightly observed

Rank C: The streak was clearly observed by visual observation

The degree of crack formation after coating and drying the interlayer was also evaluated according to that the crack was either visually confirmed or not the same as in the evaluation of the above item (2).

The results of the evaluation are listed in Tables 2 and 3. In Tables 2 and 3, an appropriate domain is surrounded with a thick black line, in which "rank A" is obtained with respect to the all evaluation items.

Further, the IR peak ratio of the interlayer of each of the samples was measured. The value of IR peak ratio of an interlayer measured before coated with a photoconductive layer was almost the same as that of the interlayer on which a photoconductive layer was once coated and was wiped off with chloromethane. Furthermore, the values of IR peak ratio of interlayers having the same composition and the same thickness were almost the same unrelated with the surface roughness of the substrate. Therefore, the IR peak ratio of a kind of interlayer is shown in the tales by the average of the IR peak values taken from of the samples having the interlayers each the same in the composition and the thickness thereof. The IR absorption spectrum of the interlayer provided on the substrate was measured by Jassen Microscopic Fourier Transform Infrared Spectrophotometer, and the IR peak ratio was determined by the foregoing method.

TABLE 2

Organic metal compound and silane coupling agent: (A3) + (B1),

Surface roughness and layer thickness: values of interlayer

| Layer thickness (μm) | IR peak ratio | Evaluation item | Surface roughness (μm) Rmax / Rz | 0 / 0 | 0.3 / 0.3 | 0.5 / 0.5 | 1.0 / 0.9 | 2.1 / 2.0 | 3.0 / 2.9 | 4.1 / 4.0 | 4.6 / 4.5 |
|---|---|---|---|---|---|---|---|---|---|---|---|
| 0.25 | 1.3 | Crack | | A | A | A | A | A | A | A | A |
| | | Image | ① | B | B | B | C | C | C | C | C |
| | | | ② | A | A | A | A | A | A | A | C |
| 0.35 | 1.4 | Crack | | A | A | A | A | A | A | A | A |
| | | Image | ① | B | B | A | B | B | B | C | C |
| | | | ② | A | A | A | A | A | A | A | C |
| 0.5 | 1.6 | Crack | | B | B | A | A | A | A | A | A |
| | | Image | ① | B | B | A | A | A | B | B | C |
| | | | ② | A | A | A | A | A | A | A | C |
| 1.0 | 1.8 | Crack | | C | B | A | A | A | A | A | A |
| | | Image | ① | C | B | A | A | A | A | A | A |
| | | | ② | A | A | A | A | A | A | A | C |
| 2.0 | 2.0 | Crack | | C | C | A | A | A | A | A | A |
| | | Image | ① | C | C | A | A | A | A | A | A |
| | | | ② | A | A | A | A | A | A | A | C |
| 3.0 | 2.2 | Crack | | C | C | A | A | A | A | A | A |
| | | Image | ① | C | C | A | A | A | A | A | A |
| | | | ② | A | A | A | A | A | A | A | B |
| 4.0 | 2.3 | Crack | | C | C | C | C | A | A | A | A |
| | | Image | ① | C | C | C | C | A | A | A | B |
| | | | ② | A | A | A | A | A | A | A | A |
| 5.0 | 2.5 | Crack | | C | C | C | C | C | C | A | A |
| | | Image | ① | C | C | C | C | C | C | A | A |
| | | | ② | A | A | A | A | A | A | A | B |
| 6.0 | 2.7 | Crack | | C | C | C | C | C | C | C | C |
| | | Image | ① | C | C | C | C | C | C | C | C |
| | | | ② | A | A | A | A | A | A | A | B |

TABLE 2-continued

①: Nonuniformity in blackened olid image (fine white spot)
②: Streak-like nonuniformity of density

TABLE 3

Organic metal compound and silane coupling agent: (A3) + (B2),
Surface roughness and layer thickness: values of interlayer

| Layer thickness (μm) | IR peak ratio | Evaluation item | Surface roughness (μm) Rmax / Rz | 0 / 0 | 0.3 / 0.3 | 0.5 / 0.5 | 1.0 / 0.9 | 2.1 / 2.0 | 3.0 / 2.9 | 4.1 / 4.0 | 4.6 / 4.5 |
|---|---|---|---|---|---|---|---|---|---|---|---|
| 0.25 | 3.0 | Crack | | A | A | A | A | A | A | A | A |
| | | Image | ① | B | B | B | C | C | C | C | C |
| | | | ② | A | A | A | A | A | A | A | C |
| 0.35 | 3.2 | Crack | | A | A | A | A | A | A | A | A |
| | | Image | ① | B | B | A | B | B | B | C | C |
| | | | ② | A | A | A | A | A | A | A | C |
| 0.5 | 3.6 | Crack | | B | B | A | A | A | A | A | A |
| | | Image | ① | B | B | A | A | A | B | B | C |
| | | | ② | A | A | A | A | A | A | A | C |
| 1.0 | 4.0 | Crack | | C | B | A | A | A | A | A | A |
| | | Image | ① | C | B | A | A | A | A | A | A |
| | | | ② | A | A | A | A | A | A | A | C |
| 2.0 | 4.4 | Crack | | C | B | A | A | A | A | A | A |
| | | Image | ① | C | B | A | A | A | A | A | A |
| | | | ② | A | A | A | A | A | A | A | C |
| 3.0 | 4.8 | Crack | | C | B | A | A | A | A | A | A |
| | | Image | ① | C | B | A | A | A | A | A | A |
| | | | ② | A | A | A | A | A | A | A | B |
| 4.0 | 5.1 | Crack | | C | C | C | B | A | A | A | A |
| | | Image | ① | C | C | C | B | A | A | A | B |
| | | | ② | A | A | A | A | A | A | A | A |
| 5.0 | 5.5 | Crack | | C | C | C | C | C | B | A | A |
| | | Image | ① | C | C | C | C | C | B | A | A |
| | | | ② | A | A | A | A | A | A | A | B |
| 6.0 | 5.9 | Crack | | C | C | C | C | C | C | C | C |
| | | Image | ① | C | C | C | C | C | C | C | C |
| | | | ② | A | A | A | A | A | A | A | B |

Figure 7:
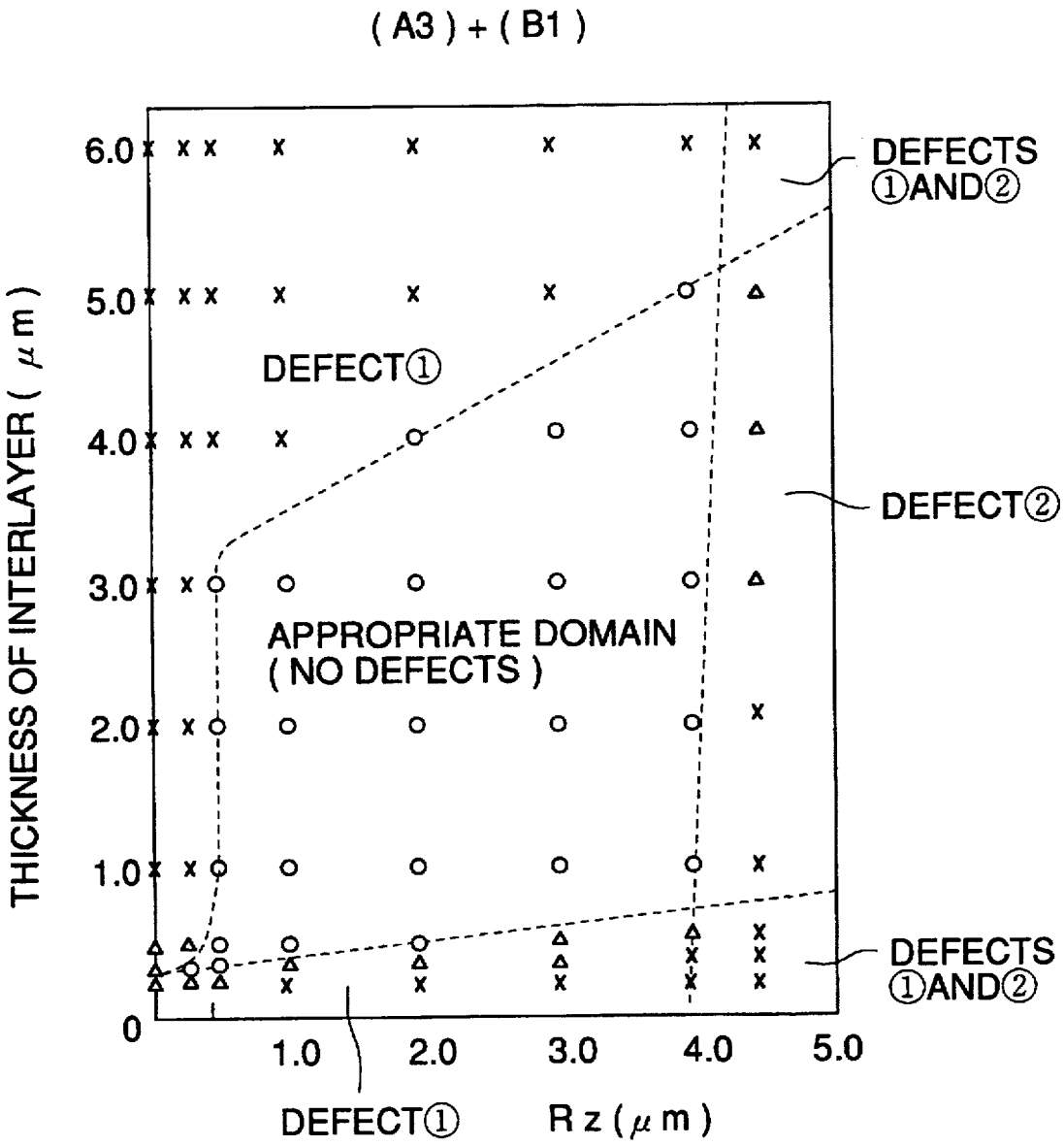
FIG. 7: A graph showing relation between the surface roughness of substrate, thickness of interlayer and image properties of photoreceptor
Figure 8:
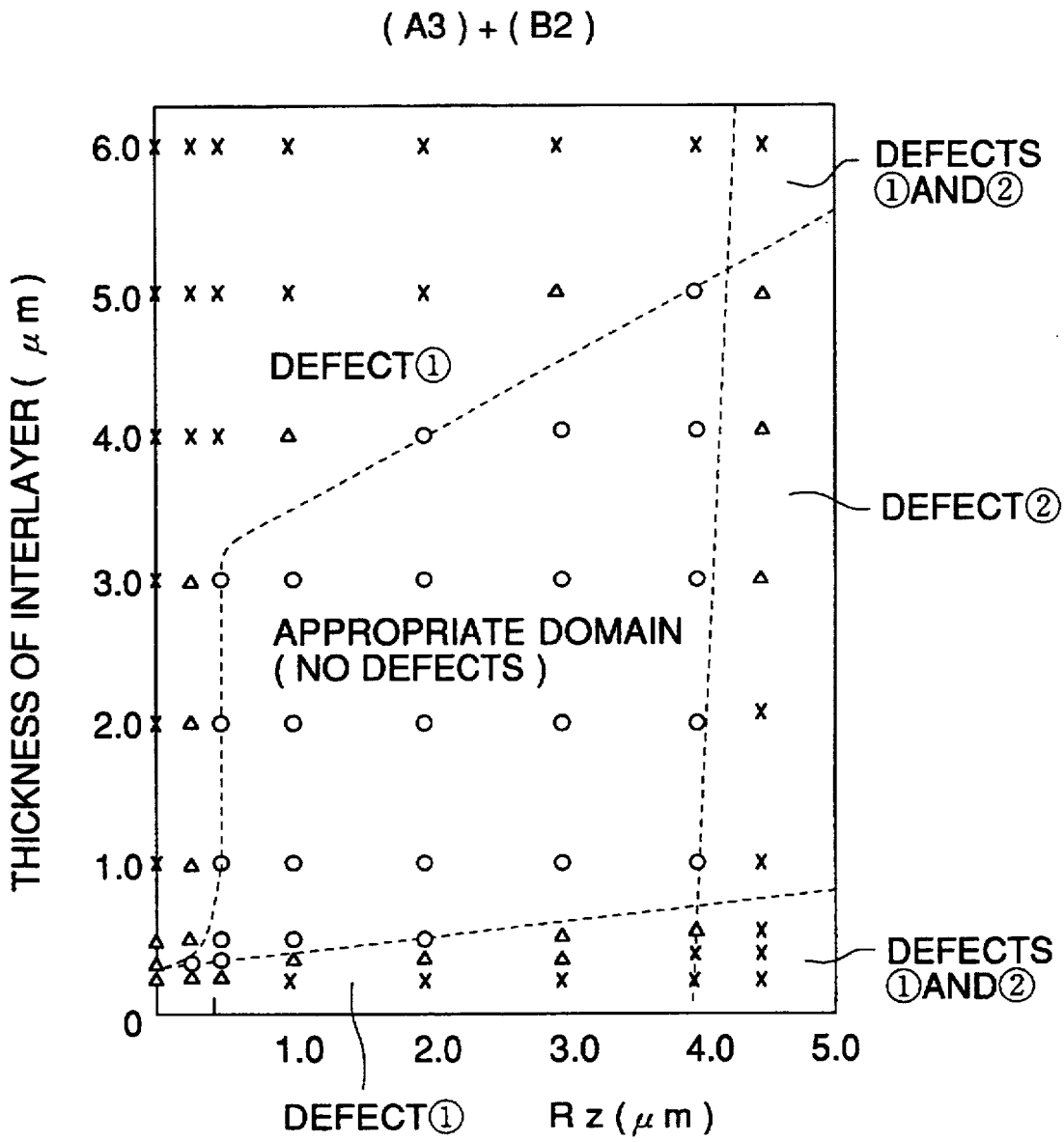
FIG. 8: A graph showing relation between the surface roughness of substrate, thickness of interlayer and image properties of photoreceptor

①: Nonuniformity in blackened olid image (fine white spot)
②: Streak-like nonuniformity of density FIGS. 7 and 8 each shows an appropriately usable domain of the combination of the maximum surface roughness and thickness of interlayer in which a good properties can be obtained. In the figures, ranks of image properties obtained by various combinations of the surface roughness $R_z$ and the thickness of interlayer (L) are plotted with the symbols of A, B and C each corresponding to ranks A, B and C.

In the figures, the ranks are plotted according to the lower ranks (a principal reason of that the combination of the plotted point cannot be included in the appropriately usable domain) among those given in the evaluations (1) and (2) for each of the plotted points.

The domain of combination of $R_z$ and L in which both of the properties evaluated in evaluations (1) and (2) are good (rank A) is encircled by a broken line.

Further, the factor by which good results cannot obtained is also described in the figures.

[Evaluation 2]

The photoreceptors prepared in Examples 1 to 17 were evaluated with respect to the status of crack formation and the image forming properties in the same manner as in Evaluation 1, provided that a sample is classified to an excellent rank A among the samples ranked B in the evaluation item (1) when the samples gives an image which does not include a section having a white-spot in the area corresponding to one round of the photo-receptor drum.

The following items were also evaluated as to the static charge properties.

The determination was carried out in a circumstance of a temperature of 10° C. and a relative humidity of 20% (low temperature and low humidity).

Black paper potential $V_b$: A surface potential of the photoreceptor exposed to an original having a reflective density of 1.3.

Remaining potential $V_r$: A surface potential after discharging by light.

In each of Examples 3 to 16, two kinds of photo-receptors according to the followings were prepared, respectively;

1) $R_z$=0.9 μm, L=1.0 μm

2) $R_z$=2.9 μm, L=3.0 μm

Although many photoreceptors were prepared in Example 1 to 2, the samples according to the above condition were subjected to Evaluation 2.

Results of the evaluation are listed in Table 4.

TABLE 4

Results of Evaluation 2

| Sample No. | Contents of interlayer | Carrier generating substance | Example 1 Rz = 0.9 μm, L = 1.0 μm: Crack | Image quality ① | Image quality ② | Potential Vb | Potential Vr | IR peak ratio | Example 2 Rz = 2.9 μm, L = 3.0 μm: Crack | Image quality ① | Image quality ② | Potential Vb | Potential Vr | IR peak ratio |
|---|---|---|---|---|---|---|---|---|---|---|---|---|---|---|
| 1 | A3 | B1 C1 | B | A | B | 700 | 35 | 1.8 | B | A | B | 700 | 40 | 2.2 |
| 2 | A3 | B2 C1 | B | A | B | 700 | 35 | 4.0 | B | A | B | 700 | 40 | 4.8 |
| 3 | A6 | B1 C1 | B | A | B | 700 | 35 | 2.0 | B | A | B | 700 | 40 | 2.5 |
| 4 | A1 | B1 C1 | B | B | B | 700 | 30 | 0.4 | B | B | B | 700 | 35 | 0.4 |
| 5 | A2 | B1 C1 | B | A | B | 700 | 35 | 1.0 | B | A | B | 700 | 40 | 1.4 |
| 6 | A4 | B1 C1 | B | A | B | 700 | 40 | 2.5 | B | A | B | 700 | 50 | 2.9 |
| 7 | A5 | B1 C1 | B | A | B | 700 | 60 | 1.9 | B | A | B | 700 | 70 | 2.3 |
| 8 | A7 | B1 C1 | B | A | B | 700 | 35 | 2.0 | B | A | B | 700 | 40 | 2.4 |
| 9 | A8 | B1 C1 | B | A | B | 700 | 40 | 4.0 | B | A | B | 700 | 45 | 4.5 |
| 10 | A9 | B1 C1 | B | B | B | 700 | 60 | 0.4 | B | B | B | 700 | 70 | 0.4 |
| 11 | A10 | B1 C1 | B | B | B | 700 | 60 | 0.4 | B | B | B | 700 | 70 | 0.4 |
| 12 | A3 | B3 C1 | B | A | B | 700 | 35 | 3.5 | B | A | B | 700 | 40 | 3.9 |
| 13 | A3 | B4 C1 | B | A | B | 700 | 40 | 8.0 | B | A | B | 700 | 45 | 8.3 |
| 14 | A3 | B5 C1 | B | B | B | 700 | 60 | 0.4 | B | B | B | 700 | 70 | 0.4 |
| 15 | A3 | B1 C2 | B | A | B | 700 | 25 | 1.8 | B | A | B | 700 | 30 | 2.3 |
| 16 | A3 | B1 C3 | B | A | B | 700 | 40 | 1.8 | B | A | B | 700 | 45 | 2.2 |
| 17 | Polyamide | C1 | B | C | B | 700 | 100 | — | B | B | B | 700 | 150 | — |

①: Nonuniformity in blackened olid image (fine white spot)
②: Streak-like density nonuniformity in halftone image

[Example 18]

Photoreceptors were prepared in the same manner as in Example 1 except that the carrier generating layer was replaced by the following.

Figure 2:
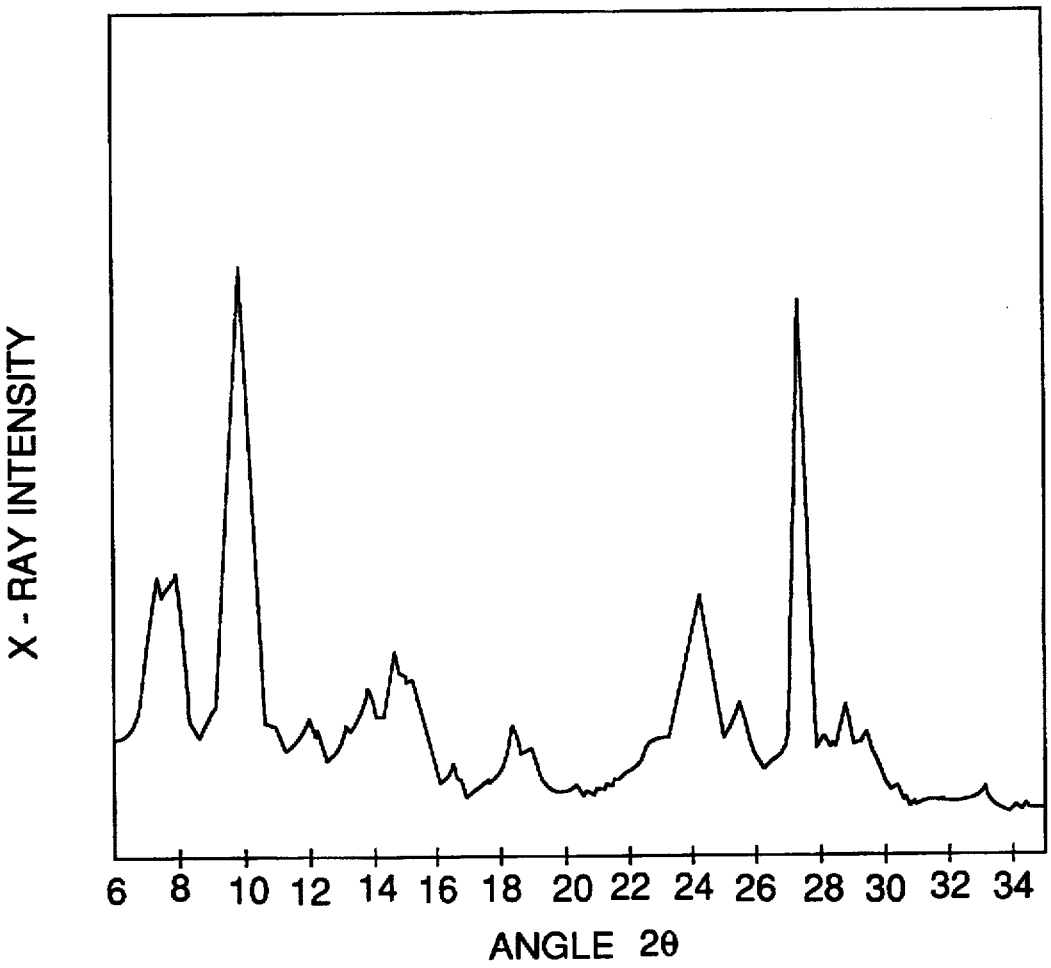
FIG. 2: X-ray diffraction spectrum of titanylphthalocyanine (Synthesis Example 2) relating to the invention

| | |
|---|---|
| Carrier generating substance (C4) (Titanylphthalocyanine synthesized in Synthesis example which has a X-ray diffraction spectrum shown in FIG. 2) | 60 g |
| Silicone resin solution (15% xylene-butanol solution of KR5240 produced by Shinetsu Kagaku Co.) | 700 g |
| Methylethylketone | 2000 ml |

The above composition was dispersed for 10 hours in a sand mill to prepare a coating liquid for carrier generating layer. The coating liquid was coated on the above-mentioned interlayer by an immersion coating method so as to form a carrier generating layer having a layer thickness of 0.2 μm.

[Synthesis Example 2]

| | |
|---|---|
| 1,3-diiminoisoindoline | 29.2 g |
| Titanium tetraisopropoxide | 17.0 g |
| Sulfolane | 200 ml |

The above composition was mixed and reacted at 140° C. for 2 hours in a nitrogen atmosphere.

After cooling, precipitates were filtered and successively washed with chloroform, 2% hydrochloric acid, water and methanol in due order. After drying, 25.5 g (88.5%) of titanylphthalocyanine (C4) was obtained.

The above product was dissolved in concentrated sulfuric acid of the amount of 20 times and poured into water of the amount of 100 times to precipitate the compound, and the precipitates were filtered. Thus obtained wet cake was heated with 1,2-dichloroethane at 50° C. for 10 hours. Thus obtained substance is in a form of crystal showing a X-ray diffraction spectrum given in FIG. 2.

[Example 19]

Photoreceptors were prepared in the same manner as in Example 18 except that the interlayer was replaced by that prepared in Example 2.

[Evaluation 3]

The photoreceptors prepared in Examples 17 and 18 were evaluated with respect to the cracks formation in the same manner as in [Evaluation 1]. The image forming properties of the photoreceptors were evaluated by practical image forming test in which the photoreceptor is mounted in a full color laser beam printer Color Laser Jet manufactured by Hewlett Packard Co. The image forming properties were evaluated as to the following three items.

(1) Black spot: Degree of black spot formation in white area in the copied image (2) Streak-like nonuniformity of density of a halftone image: Streak-lie ununiformity of density formed in a copied image having a reflective density of 0.3

(3) Density uniformity in a halftone image: Density non-uniformity formed in a halftone image having a reflective density of 0.3 caused by interference fringes.

The causes of defects the above (1) and (2), determination conditions and classification rank were the same as those in Evaluation 1. However, the defect subjected to the evaluation item (1) was "white spot" contrary to "black spot" in Evaluation 1.

The defect of (3) is an density ununiformity caused by an interference fringes formed by reflection of laser beam used to exposing the photoreceptor. The evaluation was carried out in a circumstance at a temperature of 20° C. and a relative humidity of 50% (ordinary temperature and humidity). The same standard described in the item (1) of [Evaluation 1] was applied to classification of the density uniformity caused by interference fringes.

The degree of crack formation was evaluated in the same manner as in Evaluation 1.

Results of the evaluation are listed in Tables 5 and 6. In the tables, an appropriate domains is surrounded by a shick black line, in which results of all eveluation items fall within rank A. IR peak ratios of the interlayers are abridged since the interlayer listed in Tables 5 and 6 are the same as those in Tables 2 and 3, respectively.

Figure 9:
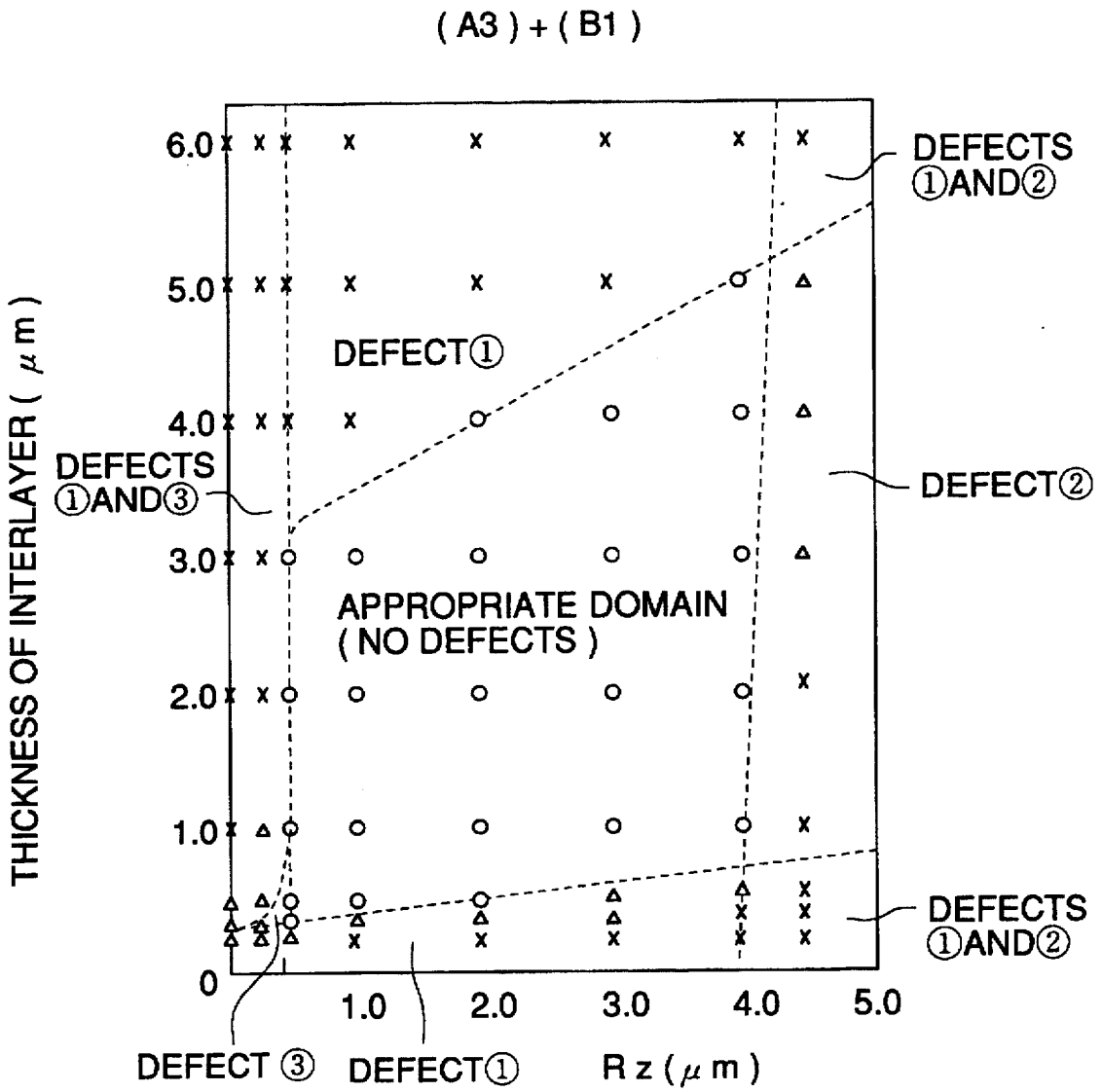
FIG. 9: A graph showing relation between the surface roughness of substrate, thickness of interlayer and image properties of photoreceptor
Figure 10:
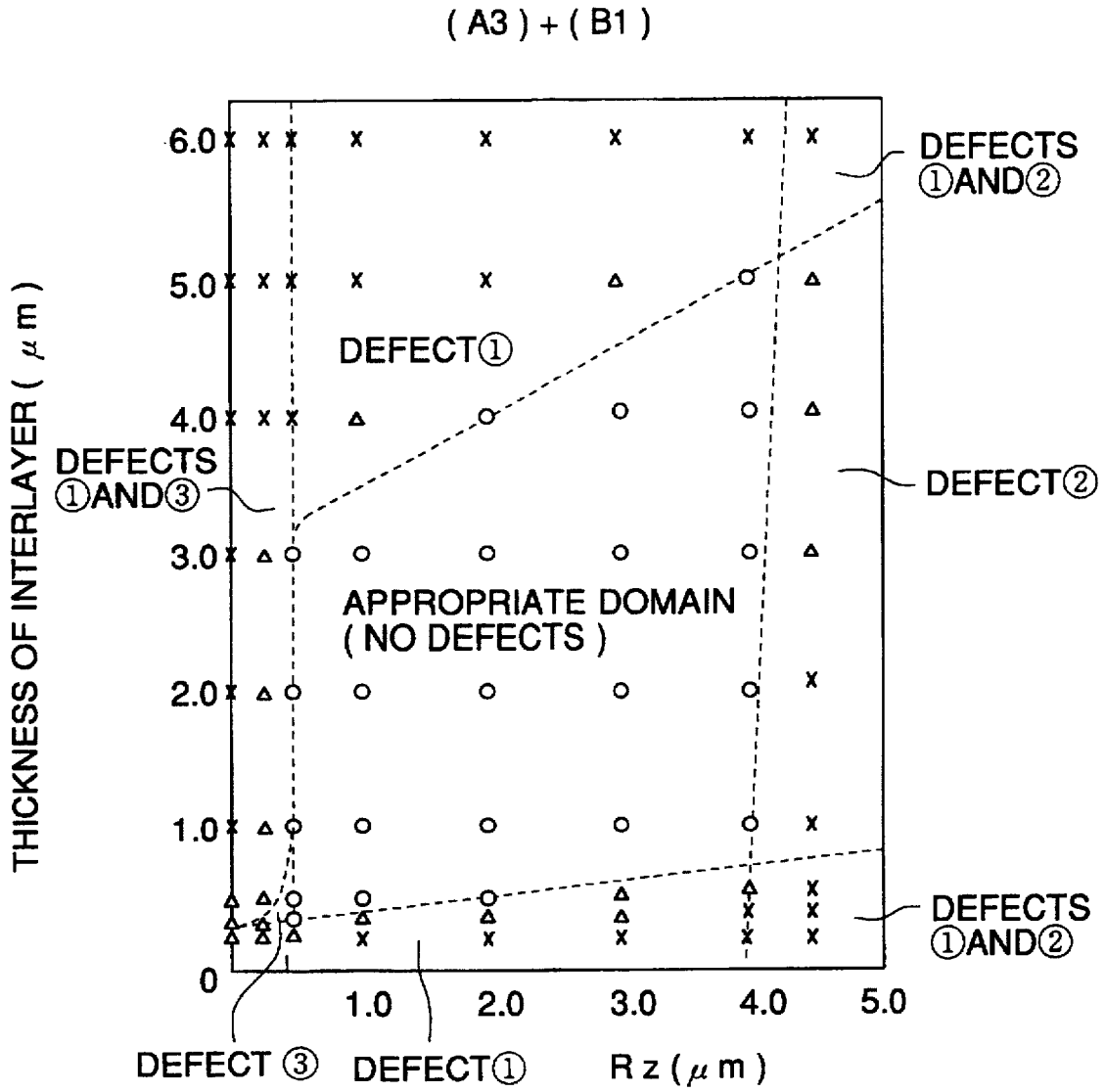
FIG. 10: A graph showing relation between the surface roughness of substrate, thickness of interlayer and image properties of photoreceptor
Figure 11:
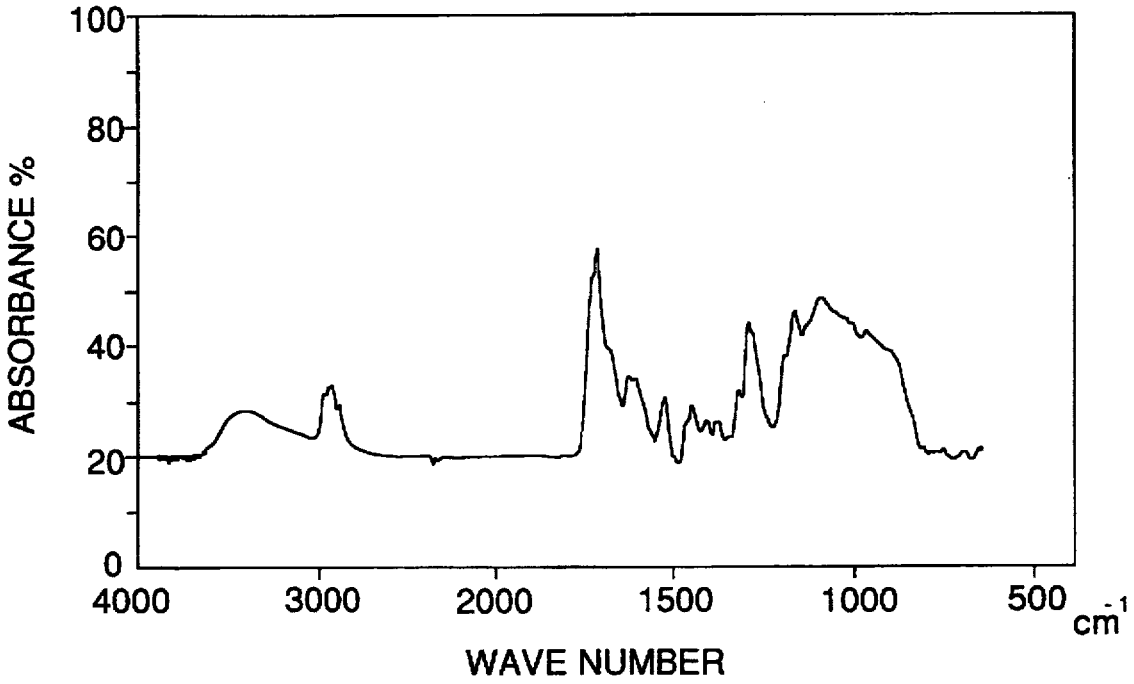
FIG. 11: An infrared absorption spectrum of the interlayer prepared in Example 1

In FIGS. 9 and 10, the appropriately usable domains are shown in the same manner as in Examples 1 and 2. In the figures, the ranks are plotted according to the lowest ranks among those given in the evaluations (1) to (3) for each of the plotted points.

TABLE 5

Organic metal compound and silane coupling agent: (A3) + (B1), Surface roughness and layer thickness: values of interlayer

| Layer thickness (μm) | Evaluation item | | Surface roughness (μm) Rmax / Rz: 0 / 0 | 0.3 / 0.3 | 0.5 / 0.5 | 1.0 / 0.9 | 2.1 / 2.0 | 3.0 / 2.9 | 4.1 / 4.0 | 4.6 / 4.5 |
|---|---|---|---|---|---|---|---|---|---|---|
| 0.25 | Crack | | A | A | A | A | A | A | A | A |
| | Image | ① | B | B | B | C | C | C | C | C |
| | | ② | A | A | A | A | A | A | A | C |
| | | ③ | C | B | A | A | A | A | A | A |
| 0.35 | Crack | | A | A | A | A | A | A | A | A |
| | Image | ① | B | B | A | B | B | B | C | C |
| | | ② | A | A | A | A | A | A | A | C |
| | | ③ | C | B | A | A | A | A | A | A |
| 0.0 | Crack | | B | B | A | A | A | A | A | A |
| | Image | ① | B | B | A | A | A | B | B | C |
| | | ② | A | A | A | A | A | A | A | C |
| | | ③ | C | B | A | A | A | A | A | A |
| 1.0 | Crack | | C | C | A | A | A | A | A | A |
| | Image | ① | C | C | A | A | A | A | A | A |
| | | ② | A | A | A | A | A | A | A | C |
| | | ③ | C | B | A | A | A | A | A | A |
| 2.0 | Crack | | C | C | A | A | A | A | A | A |
| | Image | ① | C | C | A | A | A | A | A | A |
| | | ② | A | A | A | A | A | A | A | C |
| | | ③ | C | B | A | A | A | A | A | A |
| 3.0 | Crack | | C | C | A | A | A | A | A | A |
| | Image | ① | C | C | A | A | A | A | A | A |
| | | ② | A | A | A | A | A | A | A | B |
| | | ③ | C | B | A | A | A | A | A | A |
| 4.0 | Crack | | C | C | C | C | A | A | A | A |
| | Image | ① | C | C | C | C | A | A | A | A |
| | | ② | A | A | A | A | A | A | A | B |
| | | ③ | C | B | A | A | A | A | A | A |
| 5.0 | Crack | | C | C | C | C | C | C | A | A |
| | Image | ① | C | C | C | C | C | C | A | A |
| | | ② | A | A | A | A | A | A | A | B |
| | | ③ | C | B | A | A | A | A | A | A |
| 6.0 | Crack | | C | C | C | C | C | C | C | C |
| | Image | ① | C | C | C | C | C | C | C | C |
| | | ② | A | A | A | A | A | A | A | B |
| | | ③ | C | B | A | A | A | A | A | A |

①: Black spot
②: Streak-like density nonuniformity in halftone image
③: Density nonuniformity in halftone image caused by interference fringes

TABLE 6

Organic metal compound and silane coupling agent: (A3) + (B2), Surface roughness and layer thickness: values of interlayer

| Layer thickness (μm) | Evaluation item | | Surface roughness (μm) Rmax | 0 | 0.3 | 0.5 | 1.0 | 2.1 | 3.0 | 4.1 | 4.6 |
|---|---|---|---|---|---|---|---|---|---|---|---|
| | | | Rz | 0 | 0.3 | 0.5 | 0.9 | 2.0 | 2.9 | 4.0 | 4.5 |
| 0.25 | Crack | | | A | A | A | A | A | A | A | A |
| | Image | ① | | B | B | B | C | C | C | C | C |
| | | ② | | A | A | A | A | A | A | A | C |
| | | ③ | | C | | A | A | A | A | A | A |
| 0.35 | Crack | | | A | A | A | A | A | A | A | A |
| | Image | ① | | B | B | A | B | B | B | C | C |
| | | ② | | A | A | A | A | A | A | A | C |
| | | ③ | | C | B | A | A | A | A | A | A |
| 0.5 | Crack | | | B | B | A | A | A | A | A | A |
| | Image | ① | | B | B | A | A | A | B | B | C |
| | | ② | | A | A | A | A | A | A | A | C |
| | | ③ | | C | B | A | A | A | A | A | A |
| 1.0 | Crack | | | C | B | A | A | A | A | A | A |
| | Image | ① | | C | B | A | A | A | A | A | A |
| | | ② | | A | A | A | A | A | A | A | C |
| | | ③ | | C | B | A | A | A | A | A | A |
| 2.0 | Crack | | | C | B | A | A | A | A | A | A |
| | Image | ① | | C | B | A | A | A | A | A | A |
| | | ② | | A | A | A | A | A | A | A | C |
| | | ③ | | C | B | A | A | A | A | A | A |
| 3.0 | Crack | | | C | B | A | A | A | A | A | A |
| | Image | ① | | C | B | A | A | A | A | A | A |
| | | ② | | A | A | A | A | A | A | A | B |
| | | ③ | | C | B | A | A | A | A | A | A |
| 4.0 | Crack | | | C | C | C | B | A | A | A | A |
| | Image | ① | | C | C | C | B | A | A | A | A |
| | | ② | | A | A | A | A | A | A | A | B |
| | | 3 | | C | B | A | A | A | A | A | A |
| 5.0 | Crack | | | C | C | C | C | C | B | A | A |
| | Image | ① | | C | C | C | C | C | B | A | A |
| | | ② | | A | A | A | A | A | A | A | B |
| | | ③ | | C | B | A | A | A | A | A | A |
| 6.0 | Crack | | | C | C | C | C | C | C | C | C |
| | Image | ① | | C | C | C | C | C | C | C | C |
| | | ② | | A | A | A | A | A | A | A | B |
| | | ③ | | C | B | A | A | A | A | A | A |

①: Black spot
②: Streak-like density nonuniformity in halftone image
③: Density nonuniformity in halftone image caused by interference fringes

What is claimed is:

1. An electrophotographic photoreceptor comprising an electroconductive substrate, and an interlayer and a photoconductive layer provided on said substrate in this order from the substrate, wherein the surface of said electroconductive substrate has a ten-point mean roughness $R_z$ of from 0.5 μm to 4.0 μm, said photoconductive layer comprises a titanylphthalocyanine compound, said interlayer comprises a reaction product of an organic metal compound represented by the following Formula 1 and a silane coupling agent represented by the following Formula 2, and the average thickness L of the interlayer and the ten-point mean roughness of the surface of said substrate satisfying the following requirement:

$$0.3\ \mu m+(0.1\times R_z\ \mu m)\leq L\ \mu m\leq 3.0\ \mu m+(0.5\times R_z\ \mu m)$$

Formula 1

$$(RO)_m MX_n$$

wherein R is an alkyl group; M is a titanium atom or aluminum atom; X is a chelate ligand; and m and n are each an integer of 0 to 4 and the sum of m and n is 3 or 4;

Formula 2

$$(Z)_a(A)_b Si(Y)_c$$

wherein Z is a halogen atom, an alkoxy group or an amino group; A is an alkyl group or an aryl group; and Y is an organic functional group; and a and c each an integer of 1 to 3 and b is an integer of 0 to 2 and the sum of a, b and c is 4.

2. The photoreceptor of claim 1, wherein in Formula 1, X is an ester of acetoacetic acid or a β-diketone; and in Formula 2, Y is —BOOCC(R')=$CH_2$, —BNHR" or —$BNH_2$ in which R' is an alkyl group, R" is an alkyl group or an aryl group and B is an alkylene group or an alkylene group including —O—, —NH—, —NR'— or —CO—, and n is an integer of 1 to 4.

3. The photoreceptor of claim 2, wherein the compound of formula 1 is selected from the group consisting of diisopropoxytitaniumbis(methyl acetoacetate),
diisopropoxytitaniumbis(ethyl acetoacetate),
diisopropoxytitaniumbis(propyl acetoacetate),
diisopropoxytitaniumbis(butyl acetoacetate),
dibutoxytitaniumbis(methyl acetoacetate),
dibutoxytitaniumbis(ethyl acetoacetate),
triisopropoxytitanium(methyl acetoacetate),
triisopropoxytitanium(ethyl acetoacetate),
tributoxytitanium(methyl acetoacetate),
tributoxytitanium(ethyl acetoacetate),
isopropoxytitaniumtri(methyl acetoacetate),
isopropoxytitaniumtri(ethyl acetoacetate),
isobutoxytitaniumtri(methyl acetoacetate),
isobutoxytitaniumtri(ethyl acetoacetate),
diisopropoxytitaniumbis(acetylacetodionate),
diisopropoxytitaniumbis(2,4-heptane dionate),
dibutoxytitaniumbis(acetylacetonate),
dibutoxytitaniumbis(2,4-heptanedionate),
tributoxytitanium(acetylacetonate),
tributoxytitanium(2,4-heptanedionate),
isopropoxytitaniumtri(acetylacetonate),
isopropoxytitaniumtri(2,4-heptanedionate),
isobutoxytitaniumtri(acetylacetonate),
isobutoxytitaniumtri(2,4-heptanedionate),
diisopropoxyaluminium(methyl acetoacetate),
diisopropoxyaluminium(ethyl acetoacetate),
diisopropoxyaluminium(propyl acetoacetate),
diisopropoxyaluminium(butyl acetoacetate),
dibutoxyaluminium(methyl acetoacetate),
dibutoxyaluminium(ethyl acetoacetate),
isopropoxyaluminiumbis(methyl acetoacetate),
isopropoxyaluminiumbis(ethyl acetoacetate),
isobutoxyaluminiumbis(methyl acetoacetate),
isobutoxyaluminiumbis(ethyl acetoacetate),
diisopropoxyaluminium(acetylacetonate),
dibutoxyaluminium(2,4-heptanedionate),
dibutoxyaluminium(acetylacetonate),
dibutoxyaluminium(2,4-heptanedionate),
isopropoxyaluminiumbis(acetylacetonate),
isopropoxyaluminiumbis(2,4-heptanedionate),
isobutoxyaluminiumbis(acetylacetonate), and
isobutoxyaluminiumbis(2,4-heptanedionate).

4. The photoreceptor of claim 3, wherein said titanylphthalocyanine is in a crystal form showing a Cu-Kα X-ray diffraction spector having peaks at Bragg angle 2θ of 9.6°±0.2°, 11.7°±0.2°, 15.0°±0.2°, 24.1°±0.2° and 27.2°±0.2°.

5. The photoreceptor of claim 4, wherein said interlayer gives an infrared absorption spectrum in which the ratio (b/a) of the absorbance at the maximum absorption peak being within the ranges of 1580 to 1650 $cm^{-1}$ (b) to that being within the range of 2900 to 3000 $cm^{-1}$ (a) is within the range of from 0.5 to 10.

6. The photoreceptor of claim 1, wherein said interlayer gives an infrared absorption spectrum in which the ratio (b/a) of the absorbance at the maximum absorption peak being within the range of 1580 to 1650 $cm^{-1}$ (b) to that being within the range of 2900 to 3000 $cm^{-1}$ (a) is within the range of from 0.5 to 10.

7. The photoreceptor of claim 1, wherein said titanylphthalocyanine is in a crystal form showing a Cu-Kα X-ray diffraction spector having peaks at Bragg angle 2θ of 9.6°±0.2°, 11.7°±0.2°, 15.0°±0.2°, 24.1°±0.2° and 27.2°±0.2°.

* * * * *